US009208738B2

(12) United States Patent
Kwon et al.

(10) Patent No.: US 9,208,738 B2
(45) Date of Patent: Dec. 8, 2015

(54) DISPLAY SUBSTRATE, METHOD OF MANUFACTURING THE SAME, AND DISPLAY APPARATUS HAVING THE SAME

(75) Inventors: Yeong-Keun Kwon, Suwon-si (KR); Sung-Man Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 1388 days.

(21) Appl. No.: 12/960,809

(22) Filed: Dec. 6, 2010

(65) Prior Publication Data

US 2012/0139881 A1 Jun. 7, 2012

(30) Foreign Application Priority Data

Dec. 6, 2010 (KR) ..... 10-2010-0123580

(51) Int. Cl.
*G09G 3/36* (2006.01)

(52) U.S. Cl.
CPC ..... *G09G 3/3677* (2013.01); *G09G 2300/0426* (2013.01)

(58) Field of Classification Search
CPC ..... G09G 3/3677; G09G 2300/0426
USPC ..... 345/100; 377/64–81
See application file for complete search history.

(56) References Cited

U.S. PATENT DOCUMENTS

| | | | | |
|---|---|---|---|---|
| 2006/0017686 | A1* | 1/2006 | Park | 345/100 |
| 2007/0001991 | A1* | 1/2007 | Jang et al. | 345/100 |
| 2007/0007557 | A1* | 1/2007 | Kwak et al. | 257/239 |
| 2007/0274433 | A1 | 11/2007 | Tobita | |

* cited by examiner

*Primary Examiner* — Michael Pervan
(74) *Attorney, Agent, or Firm* — H.C. Park & Associates, PLC

(57) ABSTRACT

A display apparatus includes a substrate and a display area and a peripheral area on the substrate. The peripheral area is outside the display area, and a gate driving circuit is disposed in the peripheral area. The gate driving circuit includes a first stage coupled to a first gate line and a second stage coupled to a second gate line, and the first stage and the second stage are configured as mirror images of each other.

24 Claims, 18 Drawing Sheets

DISPLAY SUBSTRATE, METHOD OF MANUFACTURING THE SAME, AND DISPLAY APPARATUS HAVING THE SAME

CROSS-REFERENCE TO RELATED APPLICATION

This application claims priority from and the benefit of Korean Patent Application No. 10-2010-0123580, filed on Dec. 6, 2010, which is hereby incorporated by reference for all purposes as if fully set forth herein.

BACKGROUND OF THE INVENTION

1. Field of the Invention

Exemplary embodiments of the present invention relate to a display apparatus driving circuit that may be formed in a smaller area using fewer conductive lines.

2. Discussion of the Background

A display device, such as a liquid crystal display (LCD) device, an organic light emitting display (OLED) device, an electro-phoretic display (EPD) device, etc., includes driving circuits that provide signals used to generate visible images. The visible images are typically generated with, for example, multiple pixels that are disposed in a display region of the display device.

The driving circuits and the display region may both be formed on the same substrate (e.g., a display substrate). Alternatively, the driving circuits may be formed, for example, on a printed circuit board and coupled to the display substrate using a connector. By forming the driving circuit on the display substrate, however, the display device may be made smaller.

A display device, such as an LCD device, includes gate lines and data lines that traverse the display region. Points where the gate lines and data lines cross each other correspond to pixels. Signals applied to the gate lines and data lines determine whether the corresponding pixels emit light, as well the intensity of the light. The driving circuits for the gate lines and data lines may be disposed in the display substrate's peripheral area, which is outside the display region. For example, a gate driving circuit, which applies gate signals to the gate lines, may be formed in the peripheral area of the display substrate. This configuration may improve manufacturing productivity of the display device.

A typical gate driving circuit includes a shift register circuit that includes multiple shift register stages cascade connected to one another. U.S. Patent Application Publication No. 2007/0274433 discloses a conventional shift register circuit. Each stage of the shift register circuit may have the same structure as the other stages. See, for example, the stages SR of FIG. 12 of U.S. Patent Application Publication No. 2007/0274433. Furthermore, signal lines are included to provide signals, such as voltage and clock signals, to the stages. In a typical gate driver, each signal line is individually connected to each stage. For example, referring to FIG. 12 of U.S. Patent Application Publication No. 2007/0274433, each stage SR receives two clock signals CLK1 and CLK2 and two voltage signals Vr and Vn. As FIG. 12 shows, each of these four signals is provided individually to each stage SR by a connection line.

SUMMARY OF THE INVENTION

Exemplary embodiments of the present invention provide a display apparatus having a gate driver with fewer connection lines.

Exemplary embodiments of present invention also provide a gate driver having multiple shift register stages, and at least a portion of one stage is configured as a mirror image of at least a portion of another stage.

Additional features of the invention will be set forth in the description which follows, and in part will be apparent from the description, or may be learned by practice of the invention.

An exemplary embodiment of the present invention discloses a display apparatus including a substrate and a display area and a peripheral area on the substrate. The peripheral area is outside the display area, and a driving circuit is disposed in the peripheral area. A first conductive line in the peripheral area extends in a first direction, and a second conductive line in the peripheral area extends in a second direction crossing the first direction. The second conductive line couples the first conductive line to the driving circuit, and the second conductive line includes a first branch coupled to a first terminal of the driving circuit and a second branch coupled to a second terminal of the driving circuit.

An exemplary embodiment of the present invention also discloses a display apparatus including a substrate with a display area and a peripheral area on the substrate. The peripheral area is outside the display area. A gate driving circuit is disposed in the peripheral area, and it includes a first stage coupled to a first gate line and a second stage coupled to a second gate line. Each of the first stage and the second stage includes a plurality of terminals. A first conductive line in the peripheral area extends in a first direction, and a second conductive line in the peripheral area extends in a second direction crossing the first direction. The second conductive line extends from the first conductive line and splits into a first part coupled to a first terminal of the first stage and a second part coupled to the first terminal of the second stage.

An exemplary embodiment of the present invention also discloses a display apparatus including a substrate and a display area and a peripheral area on the substrate. The peripheral area is outside the display area. A gate driving circuit disposed in the peripheral area includes a first stage coupled to a first gate line and a second stage coupled to a second gate line. Each of the first stage and the second stage includes a first terminal, and each of the first stage and the second stage includes a lower area and an upper area. The lower area of the first stage is disposed between the upper area of the first stage and the upper area of the second stage, and the upper area of the second stage is disposed between the lower area of the first stage and the lower area of the second stage. The first terminal of the first stage is disposed in the lower area of the first stage, and the first terminal of the second stage is disposed in the upper area of the second stage.

An exemplary embodiment of the present invention also discloses a display apparatus, including a substrate and a display area and a peripheral area on the substrate. The peripheral area is outside the display area. A gate driving circuit disposed in the peripheral area includes a first stage coupled to a first gate line and a second stage coupled to a second gate line, wherein the first stage and the second stage are configured as mirror images of each other.

An exemplary embodiment of the present invention also discloses a display apparatus, including a substrate and a display area and a peripheral area on the substrate. The peripheral area is outside the display area. A driving circuit disposed in the peripheral area includes a plurality of stages coupled to a plurality of gate lines, respectively, a first stage of the plurality of stages comprises a first terminal and a second terminal, and a second stage of the plurality of stages comprises a third terminal and a fourth terminal. A first conductive line in the peripheral area extends in a first direction, a second conductive line in the peripheral area extends in a second direction crossing the first direction, a third conductive line in the peripheral area extends in the first direction, and a fourth conductive line in the peripheral area extends in a third direction. The second conductive line couples the first conductive line to the driving circuit, and the second conductive line comprises a first branch coupled to the first terminal of the first stage and a second branch coupled to the third terminal of the second stage. The fourth conductive line couples the third conductive line to the driving circuit, and the fourth conductive line comprises a third branch coupled to the second terminal of the first stage and a fourth branch coupled to the fourth terminal of the second stage. The fourth conductive line overlaps with the plurality of gate lines, and the fourth conductive line is narrower at portions where it overlaps with the plurality of gate lines that at portions where it does not overlap with the plurality of gate lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
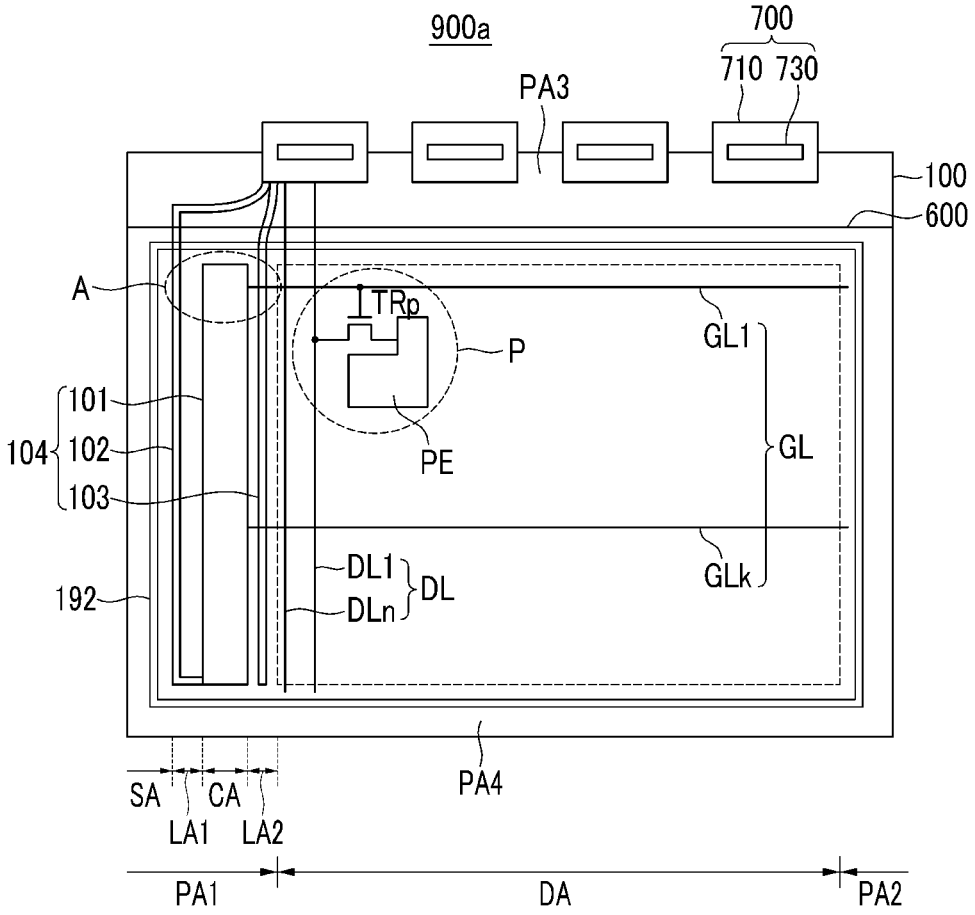
FIG. 1 is a plan view of a display apparatus according to an exemplary embodiment of the present invention.

Exemplary embodiments of the invention are described more fully hereinafter with reference to the accompanying drawings. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Hereinafter, exemplary embodiments of the present invention will be described in further detail with reference to the accompanying drawings.

FIG. 1 is a plan view of a display apparatus according to an exemplary embodiment of the present invention.

Referring to FIG. 1, the display apparatus 900*a* includes a display substrate 100 and an opposing substrate 600 facing the display substrate 100. As described below, a material disposed between the display substrate 100 and opposing substrate 600 depends on the type of display apparatus 900*a*.

The display substrate 100 includes a display area DA, in which images are formed, and a peripheral area. The peripheral area may surround the display area DA. In this case, the peripheral area may include a first peripheral area PA1, a second peripheral area PA2, a third peripheral area PA3, and a fourth peripheral area PA4. The first and second peripheral areas PA1 and PA2 are on opposite sides of the display area DA from each other. Similarly, the third and fourth peripheral areas PA3 and PA4 are on opposite sides of the display area DA from each other.

The display area DA includes multiple gate lines GL and multiple data lines DL that cross with the gate lines GL. Pixels P may be formed at crossing points of the gate lines GL and data lines DL. For example, a pixel P may include a pixel transistor TRp and a pixel electrode PE. The pixel transistor TRp is coupled to a gate line GL and a data line DL, and the pixel electrode PE is coupled to the pixel transistor TRp.

The first peripheral area PA1 is adjacent to one end of the gate lines GL, and the second peripheral area PA2 is adjacent to the other end of the gate lines GL. The third peripheral area PA3 is adjacent to one end of the data lines DL, and the fourth peripheral area PA4 is adjacent to the other end of the data lines DL.

The first peripheral area PA1 includes a sealing area SA, a first line area LA1, a circuit area CA, and a second line area LA2. A gate driver 104, which applies gate signals to the gate lines GL, is formed in the first line area LA1, circuit area CA, and second line area LA2. A sealing member 192 is formed in the sealing area SA. The sealing member 192 may also be formed in the second peripheral area PA2, the third peripheral area PA3, and the fourth peripheral area PA4, thereby sealing the display area DA.

The gate driver 104 includes a circuit 101 formed in the circuit area CA, first conductors 102 formed in the first line area LA1, and second conductors 103 formed in the second line area LA2. The first conductors 102 and the second conductors 103 are coupled to the circuit 101, and the circuit 101 produces gate signals, which are provided to the gate lines GL, using signals provided from the first and second conductors 102 and 103.

The opposing substrate 600 faces the display substrate 100 and is attached to the display substrate 100 with the sealing member 192. The opposing substrate 600 may be arranged parallel to the display substrate 100. When the display apparatus 900*a* is a liquid crystal display (LCD), a liquid crystal ("LC") layer may be disposed between the display substrate 100 and the opposing substrate 600 and sealed with the sealing member 192. When the display apparatus 900*a* is an electro-phoretic display (EPD), an electro-phoretic ink capsule may be disposed between the display substrate 100 and the opposing substrate 600 and sealed with the sealing member 192. The sealing member 192 may alternatively include a pattern that does not seal the whole outside of the electrophoretic ink capsule but opening some portion of the sealing member 192 so that the sealing member 192 attaches the display substrate 100 and the opposing substrate 600. When the display apparatus 900*a* is an organic light emitting display (OLED), the sealing member 192 may be the same as that of LCD or EPD. The sealing member 192 may be formed in the display area DA, as well as in the peripheral areas.

The data driving part 700 includes a flexible printed circuit (FPC) 710 and a data driving integrated circuit (IC) 730 formed on the FPC 710. The FPC 710 couples the data driving IC 730 to an outside device and to the display substrate 100. The data driving IC 730 may be attached directly on the display substrate 100. In this case, the display apparatus 900*a* may still include the FPC 710, which may couple the data driving IC 730 to the display substrate 100 via a conductive pattern formed on the display substrate 100. Alternatively, the driving part 700 may be formed without a data driving IC 730. In this case, a data driving circuit may be integrated on the display substrate 100 by a micro fabrication method. Even in this case, the FPC 710 may be attached to the display substrate 100 so that the display substrate 100 may communicate with an outside device through the FPC 710.

Figure 2:
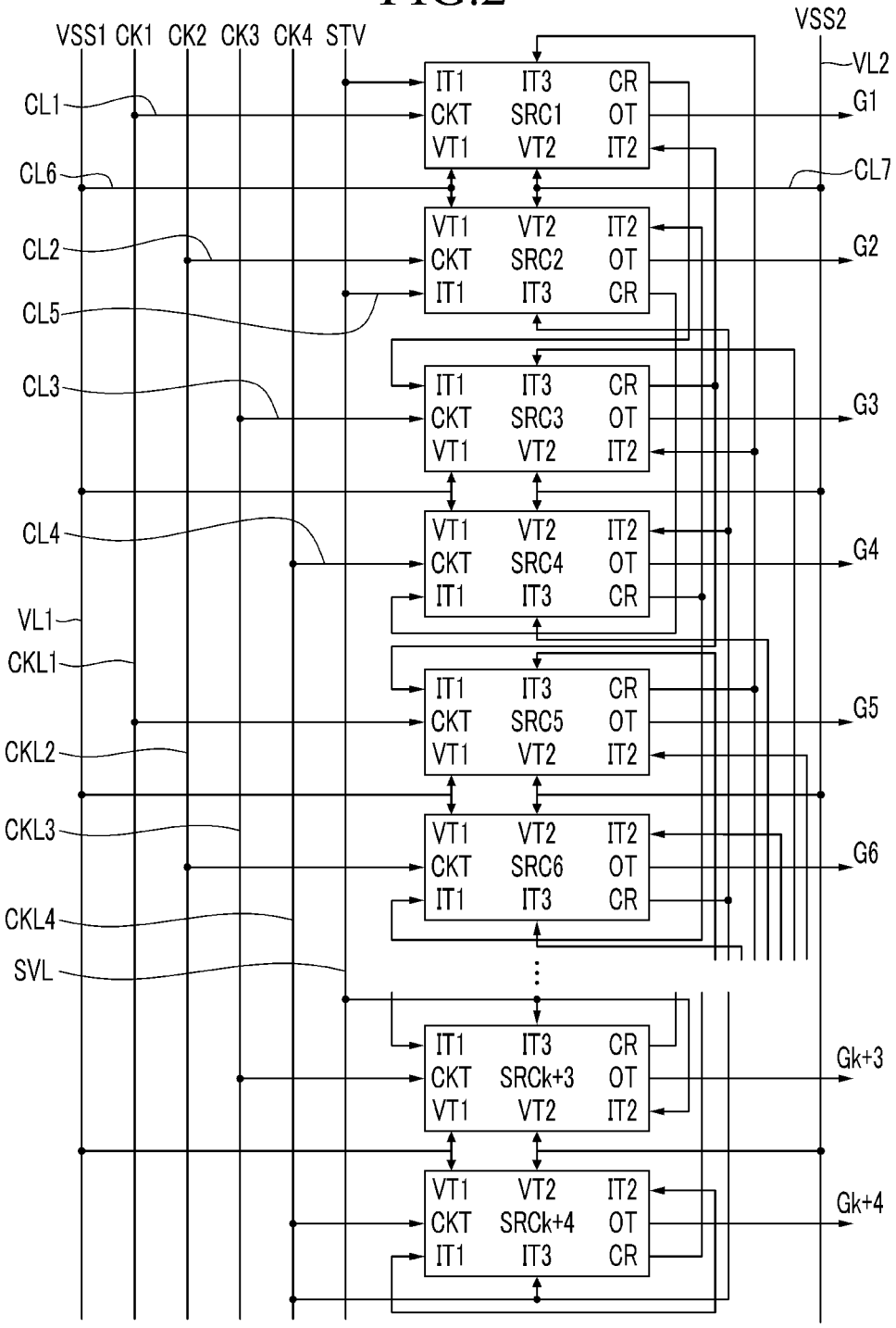
FIG. 2 is a block diagram of a gate driver of the display apparatus shown in FIG. 1 according to an exemplary embodiment of the present invention.
Figure 3:
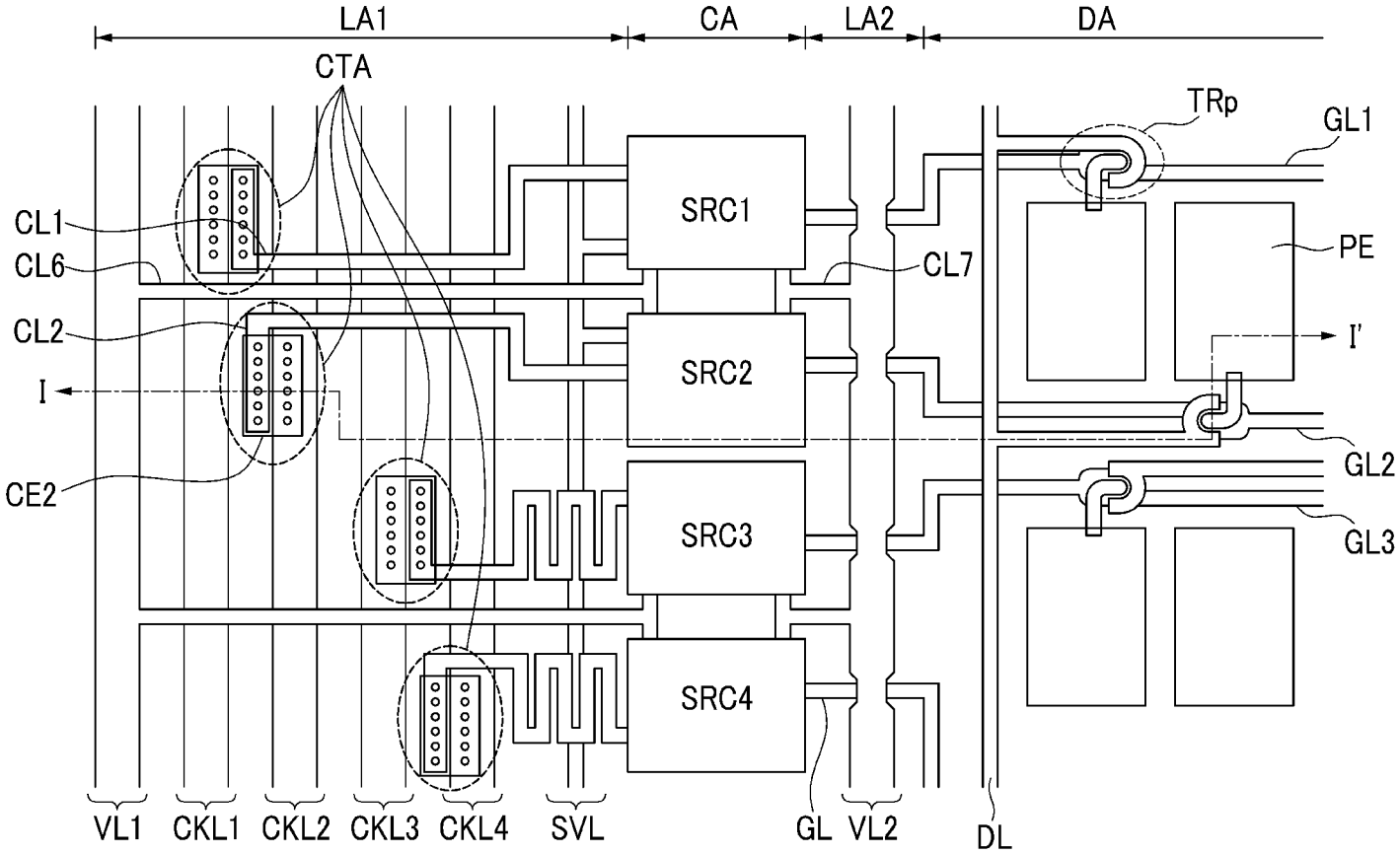
FIG. 3 is an enlarged plan view of area "A" of FIG. 1.

FIG. 2 is a block diagram of a gate driver of the display apparatus 900*a* of FIG. 1 according to an exemplary embodiment of the present invention, and FIG. 3 is an enlarged plan view of area "A" of FIG. 1. Referring to FIG. 1, FIG. 2, and FIG. 3, the gate driver 104 includes the circuit 101 formed in the circuit area CA, the first conductors 102 formed in the first line area LA1, and the second conductors 103 formed in the second line area LA2. The circuit 101 may include k shift register stages SRC1, SRC2, . . . , SRCk that are coupled to one another. Here, k may be a natural number that is equal to the number of the gate lines GL. The first stage SRC1 through the k-th stage SRCk are coupled to the first gate line GL1 through the k-th gate line GLk, respectively. Each stage SRC1 through SRCk outputs a gate signal G1 through Gk, respectively, to the corresponding gate line GL. As shown in FIG. 2, the circuit 101 may have more stages than gate lines GL. For example, FIG. 2 shows the case where there are four additional stages Gk+1 through Gk+4. These additional stages may be coupled to dummy gate lines. Furthermore, although the first stage SRC1 is shown coupled to the first gate line GL1, the circuit 101 may include dummy stages (not shown) before the first stage SRC1. These dummy stages may be coupled to dummy gate lines.

Figure 4:
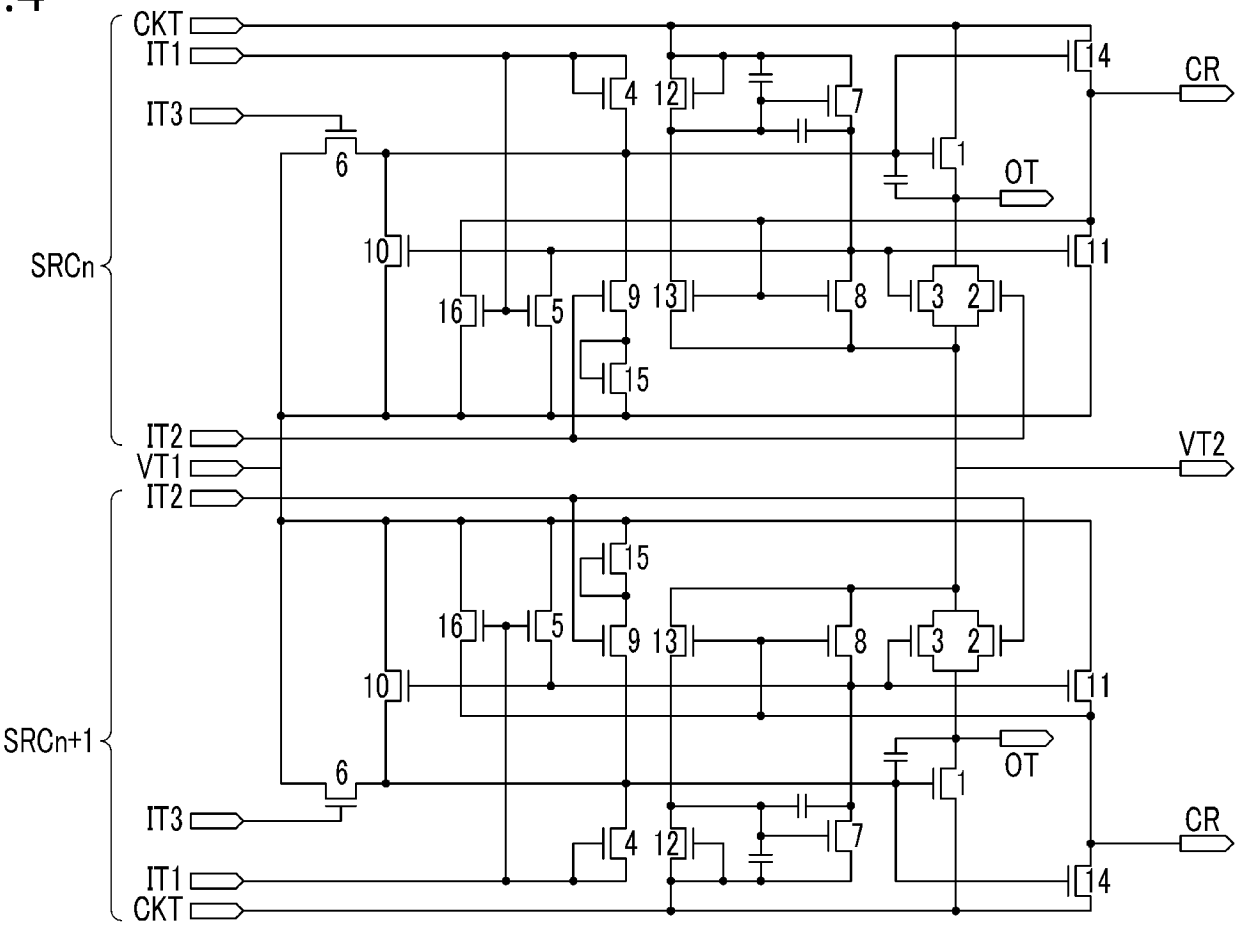
FIG. 4 is a circuit diagram of an n-th stage and n+1-th stage of the gate driver of FIG. 2 according to an exemplary embodiment of the present invention.

The circuit 101 includes stages SRC to provide gate signals to the gate lines GL. The stages SRC may be designed in numerous ways. FIG. 2 and FIG. 4 show one example of a stage according to an exemplary embodiment of the present invention. Referring to FIG. 2, an n-th stage SRCn (n is a natural number that is less than or equal to k) includes eight terminals. These eight terminals include a first input terminal IT1, a second input terminal IT2, a third input terminal IT3, a first voltage terminal VT1, a second voltage terminal VT2, a clock terminal CKT, a carry terminal CR, and an output terminal OT.

The first input terminal IT1 receives a start control signal. Depending on the stage, the start control signal may be a vertical start signal STV or it may be a carry signal CRS from a previous stage. The second input terminal IT2 and the third input terminal IT3 receive a stop control signal, which keeps a gate signal in an off state. Depending on the stage, the stop control signal may be a carry signal CRS from a following stage or a vertical start signal STV of the next frame. The first voltage terminal VT1 receives a first voltage VSS1, and the second voltage terminal VT2 receives a second voltage VSS2. The first voltage VSS1 and the second voltage VSS2 may be direct current voltages, and they may have different magnitudes from each other. The clock terminal CKT receives one of the clock signals CK1, CK2, CK3, and CK4. The output terminal OT, which is coupled to the n-th gate line GLn, outputs an n-th gate signal Gn. The carry terminal CR outputs a carry signal CRS. FIG. 2 shows that the carry terminal CR is a distinct terminal from the output terminal OT. Because the carry signal CRS and the gate signal Gn may be substantially the same signal, the carry terminal CR may alternatively be merged with the output terminal OT. In this case, the gate signal Gn output from the output terminal OT may also serve the function of the carry signal CRS. The gate signals Gn may be applied to the gate lines GL using various driving schemes, such as, for example, progressive or interlaced schemes.

The first conductors 102 include a voltage line and signal lines that substantially extend the length of the circuit 101, as well as connection lines that connect the voltage and signal lines to the stages SRC. Specifically, the first conductors 102 include a first voltage line VL1, a vertical start signal line SVL, a first clock signal line CKL1, a second clock signal line CKL2, a third clock signal line CKL3, a fourth clock signal line CKL4. The connection lines include first, second, third, fourth, fifth, and sixth connection lines CL1, CL2, CL3, CL4, CL5, and CL6. The voltage/signal lines VL1, CKL1, CKL2, CKL3, CKL4, and SVL extend in a first direction, and the first through sixth connection lines CL1, CL2, CL3, CL4, CL5, and CL6 extend in a second direction that crosses the first direction. Although the first conductors 102 are described here as being "lines," the term "lines" is used for convenience and not limitation. For example, the term "lines" does not require that the first conductors 102 be formed in a line or that they be formed of a continuous line of the same material.

The second conductors 103 include a voltage line that substantially extends the length of the circuit 101 and a connection line that connects the voltage line to the stages SRC. Specifically, the second conductors 103 include a second voltage line VL2 and a seventh connection line CL7. The second voltage line VL2 extends in the first direction, and the seventh connection line CL7 extends in a third direction, which is opposite the second direction.

The first voltage line VL1 transmits a first voltage VSS1, which is used as a gate off signal in a transistor in the shift register stages SRCn. The second voltage line VL2 transmits a second voltage VSS2, which has a different voltage level from the first voltage VSS1, and is used a gate off signal in another transistor in the shift register stages SRCn. The clock signal lines CKL1, CKL2, CKL3, and CKL4 transmit clock signals CK1, CK2, CK3, and CK4, respectively. The vertical start signal line SVL transmits a vertical start signal STV. The first through seventh connection lines CL1, CL2, CL3, CL4, CL5, CL6, and CL7 couple the lines CKL1, CKL2, CKL3, CKL4, SVL, VL1, and VL2 to the respective terminals of the shift register stages SRCn, as discussed above and as shown in FIG. 2. The first and third clock signal lines CKL1 and CKL3 may be alternatively coupled to the odd numbered stages SRC1, SRC3, SRC5, . . . , and the second and fourth clock signal lines CKL2 and CKL4 may be alternatively coupled to the even numbered stages SRC2, SRC4, SRC6, . . . .

The voltage, signal, and connection lines of the first and second conductors 102 and 103 may be formed using various combinations of conductive layers. For example, the clock signal lines CKL1, CKL2, CKL3, and CKL4 and the vertical start signal line SVL may be formed with a first conductive layer. The first and second voltage lines VL1 and VL2 and the first through seventh connection lines CL1, CL2, CL3, CL4, CL5, CL6, and CL7 may be formed with a second conductive layer. Here, an insulating layer may be formed on the first conductive layer, and the second conductive layer may be formed on the insulating layer. Lines formed of the first conductive layer may be coupled to lines formed of the second conductive layer via a third conductive layer. Alternatively, lines formed of the first conductive layer may be directly coupled to lines formed of the second conductive layer via a contact hole formed in the insulating layer.

FIG. 2 and FIG. 3 show that a single, sixth connection line CL6 is used to couple the first voltage line VL1 to two adjacent stages (e.g., SRC1 and SRC2, SRC3 and SRC4, . . . ). More specifically, a single, sixth connection line CL6 extends from the first voltage line VL1 and splits into a first branch and a second branch. The first branch is coupled to the first voltage terminal VT1 of one stage SRCn, and the second branch is coupled to the first voltage terminal VT1 of an adjacent stage SRCn+1. Similarly, a single, seventh connection line CL7 is used to couple the second voltage line VL2 to two adjacent stages (e.g., SRC1 and SRC2, SRC3 and SRC4, . . . ). More specifically, a single, seventh connection line CL7 extends from the second voltage line VL2 and splits into a third branch and a fourth branch. The third branch is coupled to the second voltage terminal VT2 of one stage SRCn, and the fourth branch is coupled to the second voltage terminal VT2 of an adjacent stage SRCn+1. This configuration allows fewer connection lines than the conventional configuration, in which each stage is individually connected to a voltage line with a connection line. Therefore, more conductor lines can be integrated in the same area so that a finer display and a higher definition display can beneficially adopt this design. Further, the electric load of the signal lines and the connection lines may also be reduced because with fewer connection lines, there are fewer overlaps of signal and connection lines. Therefore, the display's quality can be enhanced. Furthermore, as shown in FIG. 3, because fewer sixth connection lines CL6 are used (i.e., leaving more space between adjacent connections lines CL6), the contact area CTA between the clock signal lines CKL1, CKL2, CKL3, and CKL4 and the first through fourth connection lines CL1, CL2, CL3, and CL4 may be increased, which reduces electrical resistance of the connection and reduces a burnt defect.

The first voltage VSS1 and the second voltage VSS2 may be direct current voltages. In this case, they are less affected by noise than a spherical wave signal and other alternating current signals. Although the clock signals CK1, CK2, CK3, and CK4 and the vertical start signal STV may be more susceptible to being affected by noise, the first through fifth connection lines CL1, CL2, CL3, CL4, and CL5 still may have a similar shape to the sixth and seventh connection lines CL6 and CL7 to realize finer displays and/or higher definition displays.

Although the sixth and seventh connection lines CL6 and CL7 are each shown splitting into two branches, other connection lines may split into two branches depending on the configuration of the stages. Further, the sixth and seventh connection lines CL6 and CL7 or other connection lines may split into three or more branches so that one connection line may be coupled to three or more stages or three or more terminals of the stages. Furthermore, FIG. 2 and FIG. 3 show the gate driver 104 including four clock signal lines so that four clock signals may be provided to the stages. Alternatively, exemplary embodiments of the present invention may be applied to gate drivers including fewer clock signal lines (e.g., two) or more clock signal lines (e.g., six).

FIG. 2 and FIG. 3 show the second voltage line VL2 in the second line area LA2, which is between the circuit area CA and the display area DA. Thus, in this case, the second voltage line VL2 overlaps the gate lines GLn. Consequently, as shown in FIG. 3, portions of the second voltage line VL2 that overlap with the gate lines GL may be narrower than portions of the second voltage line VL2 that do not overlap with the gate lines GL. Although FIG. 2 and FIG. 3 show that only the second voltage line VL2 overlaps with the gate lines GL, the other signal lines CKL1, CKL2, CKL3, CKL4, SVL, and VL1, as well as the first through seventh connection lines CL1, CL2, CL3, CL4, CL5, CL6, and CL7, may overlap with the gate lines GL. In this case, the signal or connection lines may have a similar shape as that of the second voltage line VL2. The gate signals Gn, which directly control the pixel transistor TRp in the display area DA, may be sensitive to noise. Thus, gate signals Gn that are affected by noise may degrade image quality. Further, signals transferred to the shift register stages may be also be sensitive to noise. Therefore, the voltage lines, the signal lines, the connection lines, and/or other conductor lines used in the peripheral area may narrow in an area where each overlaps with another conductive line.

FIG. 4 is a circuit diagram of an n-th stage and n+1-th stage of the gate driver of FIG. 2 according to an exemplary embodiment of the present invention. Referring to an n-th stage SRCn in FIG. 2 and FIG. 4, one of the first to fourth clock signal lines CKL1, CKL2, CKL3, and CKL4 is coupled to the clock terminal CKT through the first to fourth connection line CL1, CL2, CL3 or CL4, respectively. The first voltage line VL1 is coupled to the first voltage terminal VT1 through the sixth connection line CL6, and the second voltage line VL2 is coupled to the second voltage terminal VT2 through the seventh connection line CL7.

Unlike conventional shift register stages, the n-th stage SRCn and the n+1-th stage SRCn+1 do not have the same configuration. Referring to FIG. 2 and FIG. 4, the first voltage terminal VT1 of the first stage SRC1 is disposed at a lower portion of the first stage SRC1, and the first voltage terminal VT1 of the second stage SRC2 is disposed at an upper portion of the second stage SRC2. Similarly, the second voltage terminal VT2 of the first stage SRC1 is disposed at the lower portion of the first stage SRC1, and the second voltage terminal VT2 of the second stage SRC2 is disposed at the upper portion of the second stage SRC2. Thus, unlike the conventional configuration, this configuration allows the first voltage terminals VT1 of the first and second stages SRC1 and SRC2 to face each other and the second voltage terminals VT2 of the first and second stages SRC1 and SRC2 to face each other.

When neighboring stages are configured with like terminals facing each other, less wiring may be needed because at lease one connection line of the first through seventh connection lines CL1, CL2, CL3, CL4, CL5, CL6, and CL7 may be coupled to two or more stages.

According to an exemplary embodiment of the present invention, the structure of the n+1-th stage SRCn+1 may be a mirror image of the structure of the n-th stage SRCn. In FIG. 2 and FIG. 4, the entire n-th stage SRCn and the entire n+1-th stage SRCn+1, both of which include transistors 1-16, are shown as mirror images of each other. This is not necessary, however, because some elements of the neighboring stages need not be structured in a mirror image of each other. In other words, a portion of the n-th stage SRCn may be a mirror image of a portion the n+1-th stage SRCn+1, and another portion of the n-th stage SRCn may not be a mirror image of another portion of the n+1-th stage SRCn+1.

Figure 5:
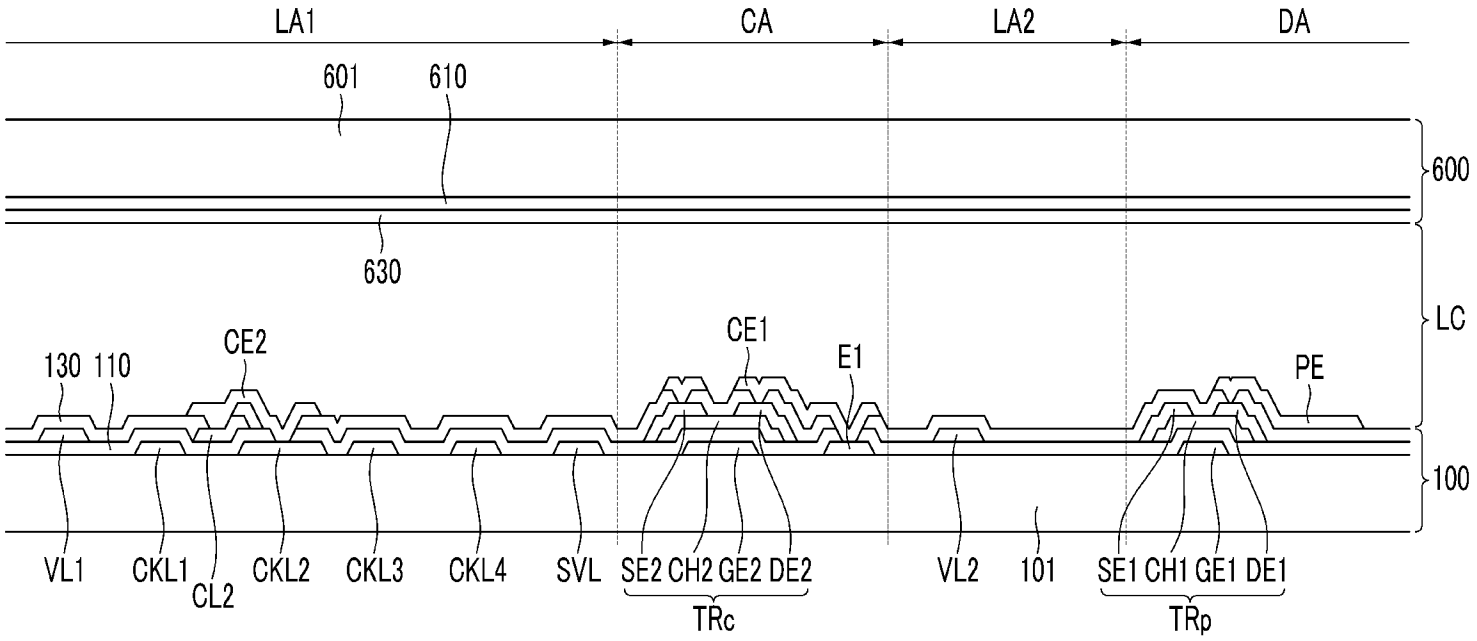
FIG. 5 is a cross-sectional view along line I-I' of FIG. 3.

FIG. 5 is a cross-sectional view along line I-I' of FIG. 3. Referring to FIG. 3 and FIG. 5, the display apparatus 900*a* includes a display substrate 100, an opposing substrate 600 arranged parallel to the display substrate 100, and a liquid crystal (LC) layer disposed between the display substrate 100 and the opposing substrate 600. When the display apparatus is an EPD, the LC layer may alternatively be an electro-phoretic ink capsule layer. When the display apparatus is an OLED, the LC layer may alternatively be an organic light emitting material. Furthermore, other structures of the display substrate 100 and the opposing substrate 600 may be substituted with appropriate structures in an EPD or an OLED as described below.

The display substrate 100 includes a base substrate 101. A pixel transistor TRp and a pixel electrode PE are formed in the display area DA of the base substrate 101. The pixel transistor TRp includes a first electrode formed with a first conductive layer and a second electrode formed with a second conductive layer.

For example, the pixel transistor TRp includes a first gate electrode GE1, a first channel pattern CH1 formed on the first gate electrode GE1, an insulating layer 110 formed between the first gate electrode GE1 and the first channel pattern CH1, and a first source electrode SE1 and a first drain electrode DE1, which are both formed on the channel pattern CH1. The first gate electrode GE1 is coupled to a gate line GLn, the first source electrode SE1 is coupled to a data line DLn, and the first drain electrode DE1 is coupled to a pixel electrode PE.

A passivation layer 130 is formed on the first source electrode SE1 and the first drain electrode DE1. The pixel electrode PE is formed on the passivation layer 130 and is coupled to the first drain electrode DE1 through a contact hole in the passivation layer 130.

The shift register stage SRCn is formed in the circuit area CA of the base substrate 101. The stage SRCn includes multiple circuit transistors TRc. The circuit transistors TRc may be connected to each other with first connection electrodes CE1. A first circuit transistor TRc includes a first electrode formed with the first conductive layer and a second electrode formed with the second conductive layer. For example, the circuit transistor TRc includes a second gate electrode GE2 formed with the first conductive layer, a second channel pattern CH2 formed on the second gate electrode GE2, the insulating layer 110 formed between the second gate electrode GE2 and the second channel pattern CH2, and a second source electrode SE2 and a second drain electrode DE2, which are both formed on the second channel pattern CH2. The passivation layer 130 is formed on the circuit transistor TRc.

The first connection electrode CE1 may be formed with the same conductive layer as the pixel electrode PE. The first connection electrode CE1 may be coupled to a first electrode E1 formed with the first conductive layer and a second electrode formed with the second conductive layer through contact holes. Here, the second electrode may be the second source electrode SE2 or the second drain electrode DE2. The first connection electrode CE1 and the first electrode E1 may couple the transistors in the stages in FIG. 4.

The first conductive layer may be used to form multiple conductive lines in the line areas LA1 and LA2. The insulating layer 110 is formed on the conductive lines made from the first conductive layer. The second conductive layer, which is formed on the insulating layer 110, may also be used to form multiple conductive lines in the line areas LA1 and LA2. The passivation layer 130 is formed on the conductive lines made from the second conductive layer.

For example, the first voltage line VL1, the clock signal lines CKL1, CKL2, CKL3, and CKL4, and the vertical start signal line SVL are formed in the first line area LA1 and extend in a first direction. The first through sixth connection lines CL1, CL2, CL3, CL4, CL5, and CL6 are formed in the first line area LA1 and extend in a second direction that crosses the first direction. The second voltage line VL2 is formed in the second line area LA2 and extends in the first direction, and the seventh connection line CL7 is formed in the second line area LA2 and extends in a third direction, which is opposite the second direction. The clock signal lines CKL1, CKL2, CKL3, and CKL4 and the vertical start signal line SVL may be formed with the first conductive layer. The first voltage line VL1, the second voltage line VL2, and the first through seventh connection lines CL1, CL2, CL3, CL4, CL5, CL6, and CL7 may be formed with the second conductive layer. An insulating layer may be disposed between the first conductive layer and the second conductive layer to insulate these conductive layers from each other. At least one of the first through seventh connection lines CL1, CL2, CL3, CL4, CL5, CL6, and CL7 may be a single connection line where it is coupled to a voltage or signal line and then split into two or more branches near the circuit area CA so that each branch may be coupled to a different stage SRCn. The passivation layer 130 is formed on the first through seventh connection lines CL1, CL2, CL3, CL4, CL5, CL6, and CL7. The circuit area CA may be disposed between the first line area LA1 and the second line area LA2.

When the display apparatus 900*a* is an LCD, a first alignment layer (not shown) may be formed on the passivation layer 130. In this case, the LC layer may be disposed between the display substrate 100 and the opposing substrate 600. The opposing substrate 600 may include a second base substrate 601, a common electrode 610, and a second alignment layer 630. The common electrode 610 may be formed on the second base substrate 601, and the alignment layer 630, which aligns the LC layer, may be formed on the common electrode 610. As an example of an alternative configuration, the common electrode 610 may be formed on the passivation layer 130 of the display substrate 100 instead of on the opposing substrate 600. The first alignment layer (not shown) and the second alignment layer 630 may be omitted when the display apparatus is an EPD or an OLED. An EPD may include an electrophoretic ink capsule layer between the display substrate 100 and the opposing substrate 600, and an OLED may include an organic light emitting material layer formed on the display substrate 100. The organic light emitting material layer may be formed on the pixel electrode PE, and the common electrode may be formed on the organic light emitting material layer.

Figure 6A:
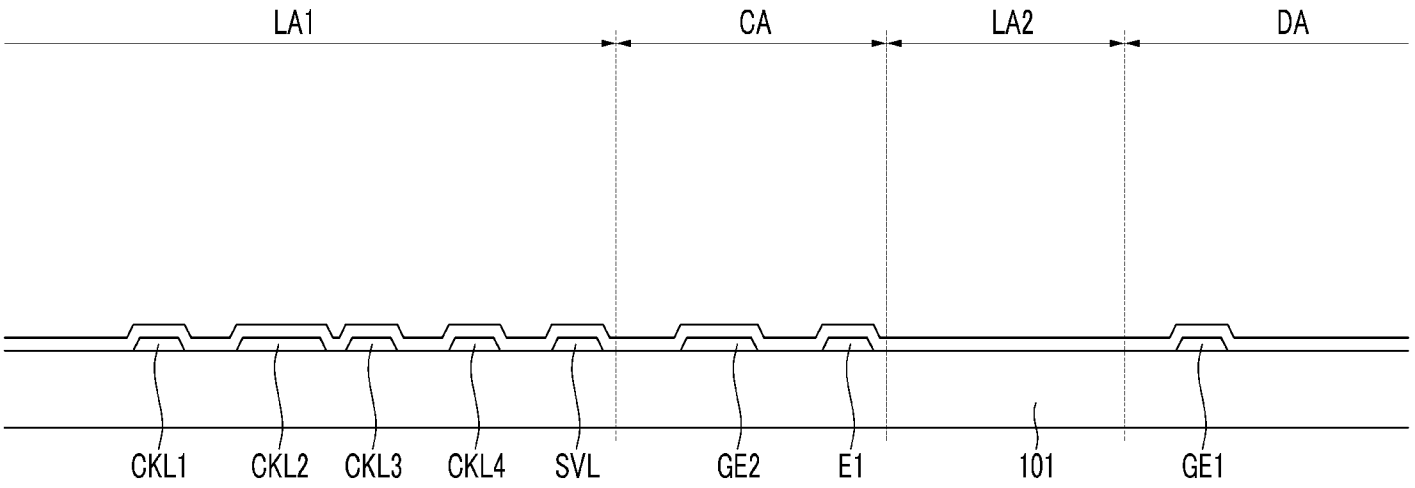
FIG. 6A, FIG. 6B, and FIG. 6C are cross-sectional views along line I-I' of FIG. 3 showing steps of fabricating a display substrate according to an exemplary embodiment of the present invention.
Figure 6B:
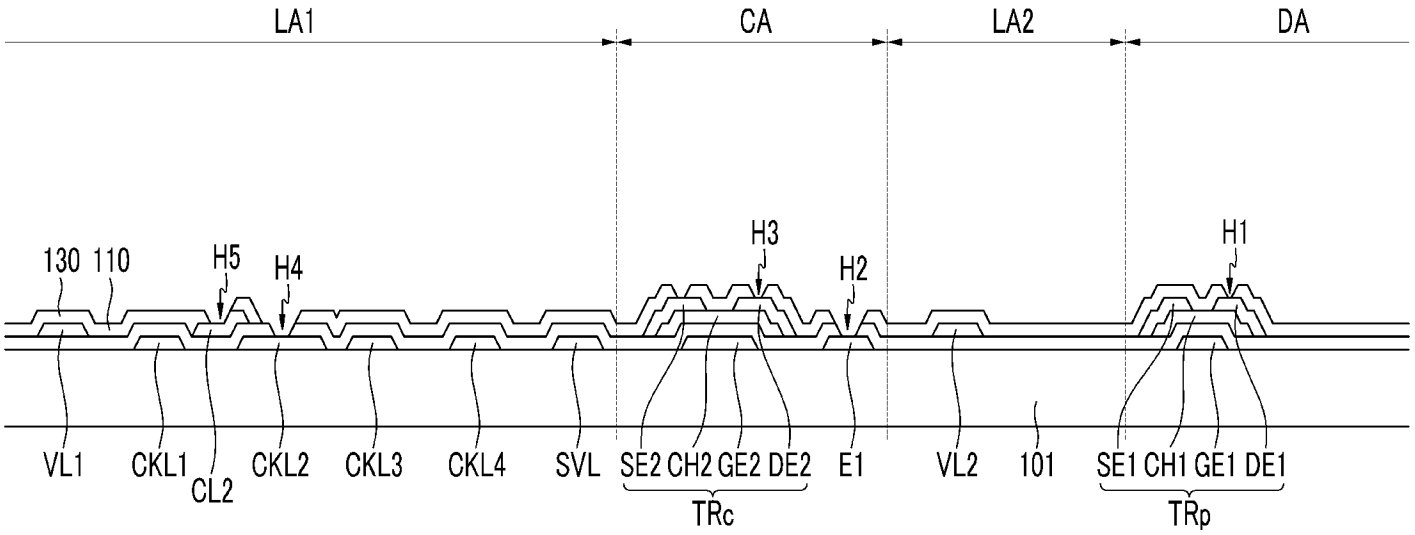
Figure 6C:
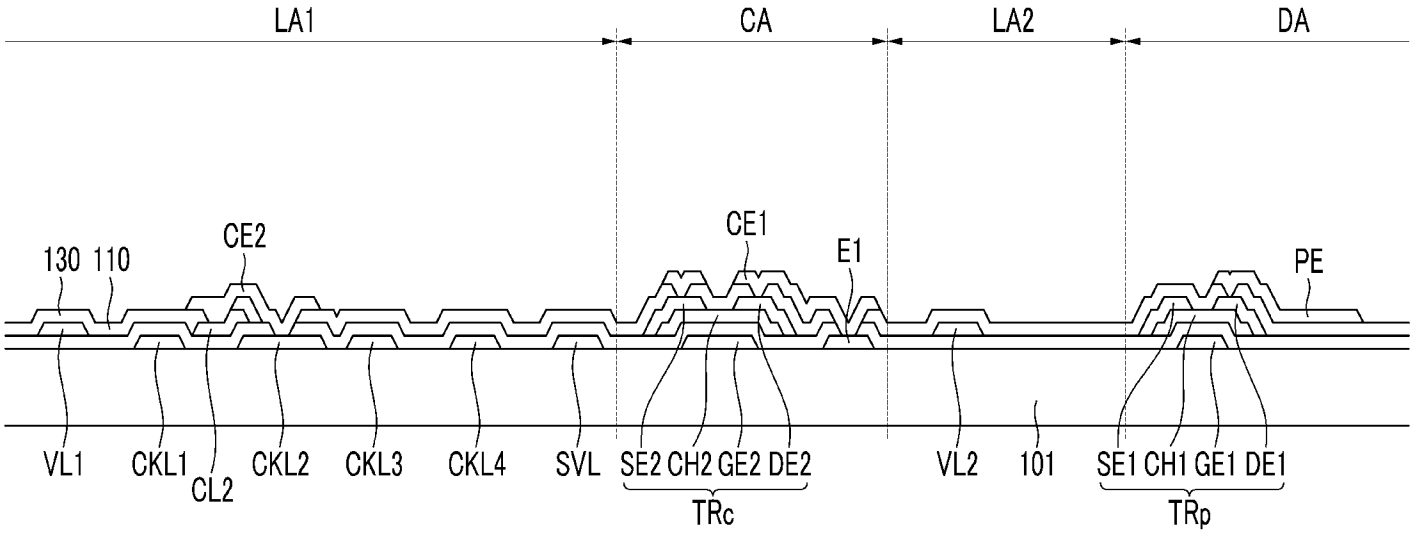

FIG. 6A, FIG. 6B, and FIG. 6C are cross-sectional views along line I-I' of FIG. 3 showing steps of fabricating a display substrate according to an exemplary embodiment of the present invention.

Referring to FIG. 3, FIG. 5, and FIG. 6A, a first conductive layer is formed on the first base substrate 101. The first conductive layer may be a single layer or multiple layers, and it may include a conductive material such as Cr, Mo, W, Al, Cu, MoW, AlNd, Ag, Au, etc. A first conductive pattern may be formed from the first conductive layer using a photolithography process. The first conductive pattern includes a gate line GL and a first gate electrode GE1 formed in a display area DA, a second gate electrode GE2 and a first electrode E1 formed in a circuit area CA, and a first clock signal line CKL1, a second clock signal line CKL2, a third clock signal line CKL3, a fourth clock signal line CKL4, and a vertical start signal line SVL formed in the first line area LA1.

An insulating layer 110 is formed on the first conductive pattern. The insulating layer 110 may include an inorganic material such as silicon nitride ($SiN_x$) or silicon oxide ($SiO_x$).

Referring to FIG. 3, FIG. 5, and FIG. 6B, a channel layer is formed on the insulating layer 110. The channel layer may be patterned using photolithography to form a channel pattern, which includes the first channel pattern CH1 in the display area DA and the second channel pattern CH2 in the circuit area CA.

Next, a second conductive layer is formed on the channel pattern and the insulating layer 110. The second conductive layer may be a single layer or multiple layers, and it may include a conductive material such as Cr, Mo, W, Al, Cu, MoW, AlNd, Ag, Au, etc. The second conductive layer may be patterned using photolithography to form a second conductive pattern. The second conductive pattern includes a data line DL, a first source electrode SE1, and a first drain electrode DE1 formed in the display area DA, a second source electrode SE2 and a second drain electrode DE2 formed in the circuit area CA, the first connection line CL1, the second connection line CL2, the third connection line CL3, the fourth connection line CL4, the fifth connection line CL5, the sixth connection line CL6, and the first voltage line VL1 formed the first line area LA1, and the seventh connection line CL7 and the second voltage line VL2 formed in the second line area LA2.

The signal lines CKL1, CKL2, CKL3, CKL4, and SVL and the voltage lines VL1 and VL2 extend in a first direction, the first through sixth connection lines CL1, CL2, CL3, CL4, CL5, and CL6 extend in a second direction, and the seventh connection line CL7 extend in a third direction. The first direction crosses the second direction, and the second and third directions are opposite directions. At least one connection line among the first through seventh connection lines CL1, CL2, CL3, CL4, CL5, CL6, and CL7 extends as a single line from its corresponding voltage or signal line and then splits into at least two branches near the circuit area CA so that each branch is coupled to a different transistor in the circuit area CA.

The channel layer may be a semiconductor layer. For example, the semiconductor layer may include a silicon layer, such as an amorphous silicon layer or a polycrystalline silicon layer. The channel layer may also include an organic semiconductor or an oxide semiconductor. The channel layer and the second conductive layer may be patterned with one photolithography process so that the channel pattern is substantially formed under the entire second conductive pattern.

A passivation layer 130 is formed on the second conductive pattern, the channel pattern, and the insulating layer 110. The passivation layer 130 may include an inorganic material, such as $SiN_x$ of $SiO_x$. The passivation layer 130 may also include an organic material instead of or in addition to the inorganic material. The organic material may include a resin.

A portion of the passivation layer 130 and a portion of the insulating layer 110 may be removed using a photography process to form contact holes. The contact holes include a first contact hole H1 formed in the display area DA, a second contact hole H2 and a third contact hole H3 formed in the circuit area CA, and a fourth contact hole H4 and a fifth contact hole H5 formed in the first line area LA1.

Referring to FIG. 3, FIG. 5, and FIG. 6C, a third conductive layer is formed on the passivation layer 130 and in the first through fifth contact holes H1, H2, H3, H4, and H5. The third conductive layer may be transparent. For example, the third conductive layer may include a transparent material such as indium tin oxide (ITO) or indium zinc oxide (IZO). The third conductive layer may be patterned using photolithography to form a transparent conductive pattern including a pixel electrode PE formed in the display are DA, a first connection electrode CE1 formed in the circuit area CA, and a second connection electrode CE2 formed in the first line area LA1. The pixel electrode PE is connected to the first drain electrode DE1 through the first contact hole H1. The first connection electrode CE1 is connected to the first electrode E1 through the second contact hole H2. The first connection electrode CE1 is also connected to the second drain electrode DE2 through the third contact hole H3. Therefore, the first connection electrode CE1 couples the first electrode E1 and the second drain electrode DE2. Alternatively, the first connection electrode CE1 may couple the first electrode E1 and the second source electrode SE2. The second connection electrode CE2 couples the second clock signal line CKL2 and the second connection line CL2

A color filter layer (not shown) may be formed between the passivation layer 130 and the pixel electrode PE. An alignment layer (not shown) may be formed on the pixel electrode PE. A light blocking layer (not shown) may be further formed on the first base substrate 101. The light blocking layer may be patterned so that the light blocking layer pattern overlaps the gate line GL, the data line DL, and/or the pixel transistor TRp.

FIG. 6A, FIG. 6B, and FIG. 6C show a method of manufacturing a display apparatus according to an exemplary embodiment of the present invention. The display apparatus may be manufactured using various methods.

Figure 10:
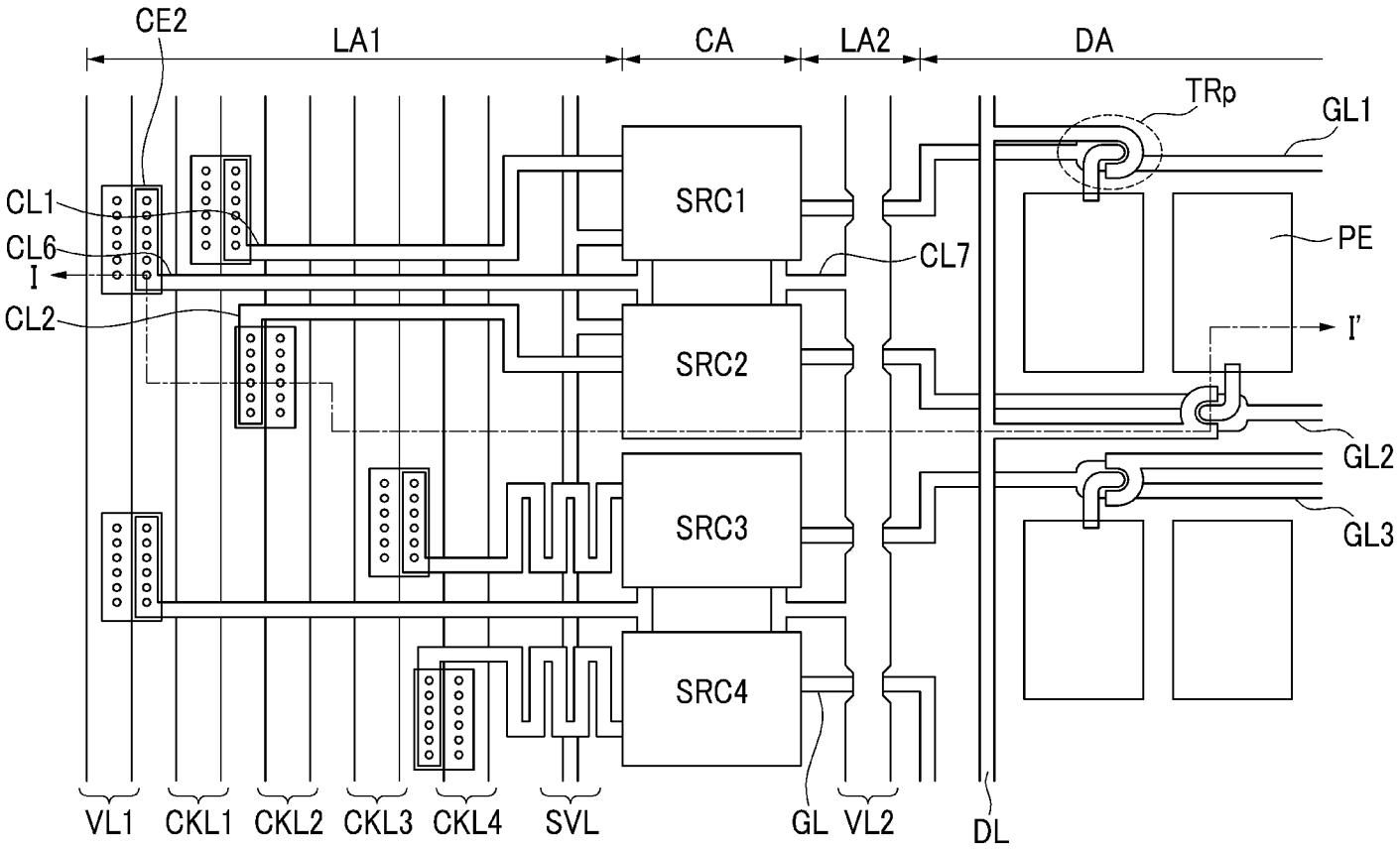
FIG. 10 is an enlarged plan view of area "A" of FIG. 1 according to an exemplary embodiment of the present invention.
Figure 11:
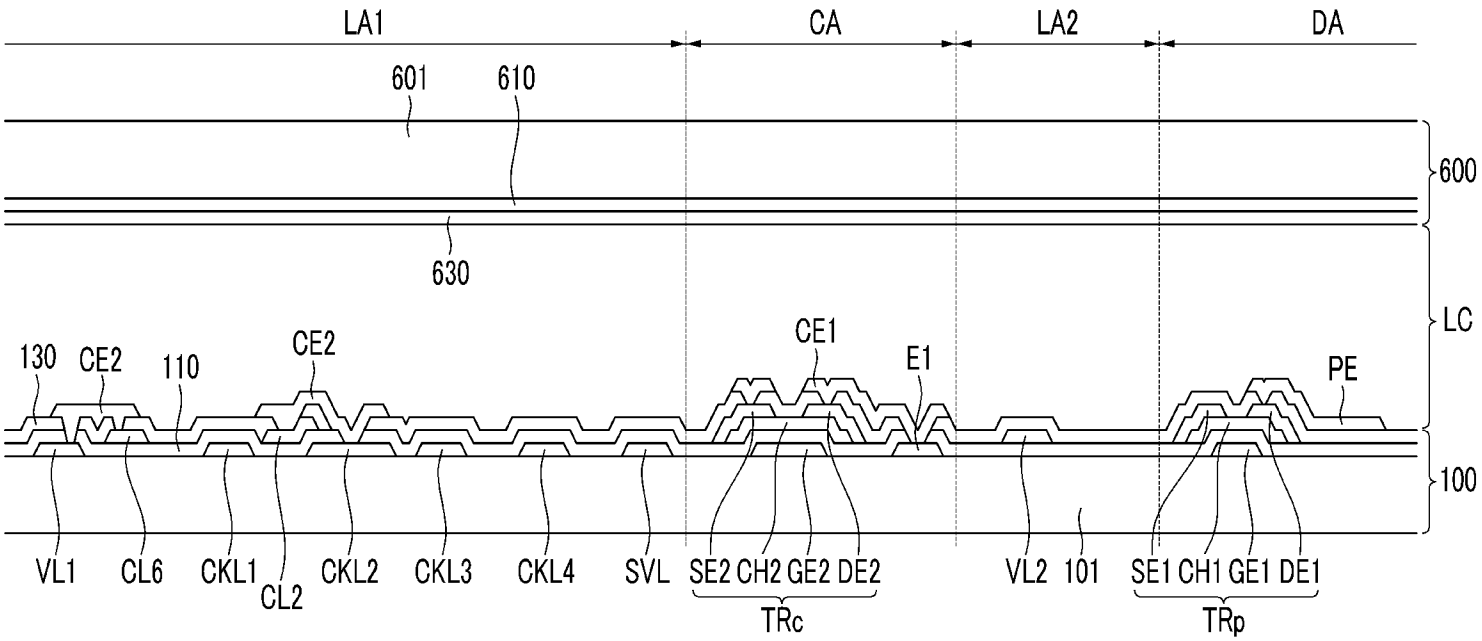
FIG. 11 is a cross-sectional view along line I-I' of FIG. 10.

For example, some or all of the first conductive pattern, which is formed from the first conductive layer, may be formed with the second conductive layer, and some or all of the second conductive pattern, which is formed from the second conductive layer, may be formed from the first conductor layer. FIG. 10 and FIG. 11 show one possible alternative according to an exemplary embodiment of the present invention. FIG. 10 is an enlarged plan view of area "A" of FIG. 1 according to an exemplary embodiment of the present invention, and FIG. 11 is a cross-sectional view along line I-I' of FIG. 10. Referring to FIG. 10 and FIG. 11, the first voltage line VL1 may be formed from the first conductive layer, and the sixth connection line CL6 may be formed from the second conductive layer. Here, the sixth connection line CL6 is coupled to the first voltage line VL1 via a contact hole in the insulating layer 110 and the passivation layer 130 and a contact hole in the passivation layer 130. A second connection electrode CE2 may be used to couple the sixth connection line CL6 to the first voltage line VL1.

Figure 12:
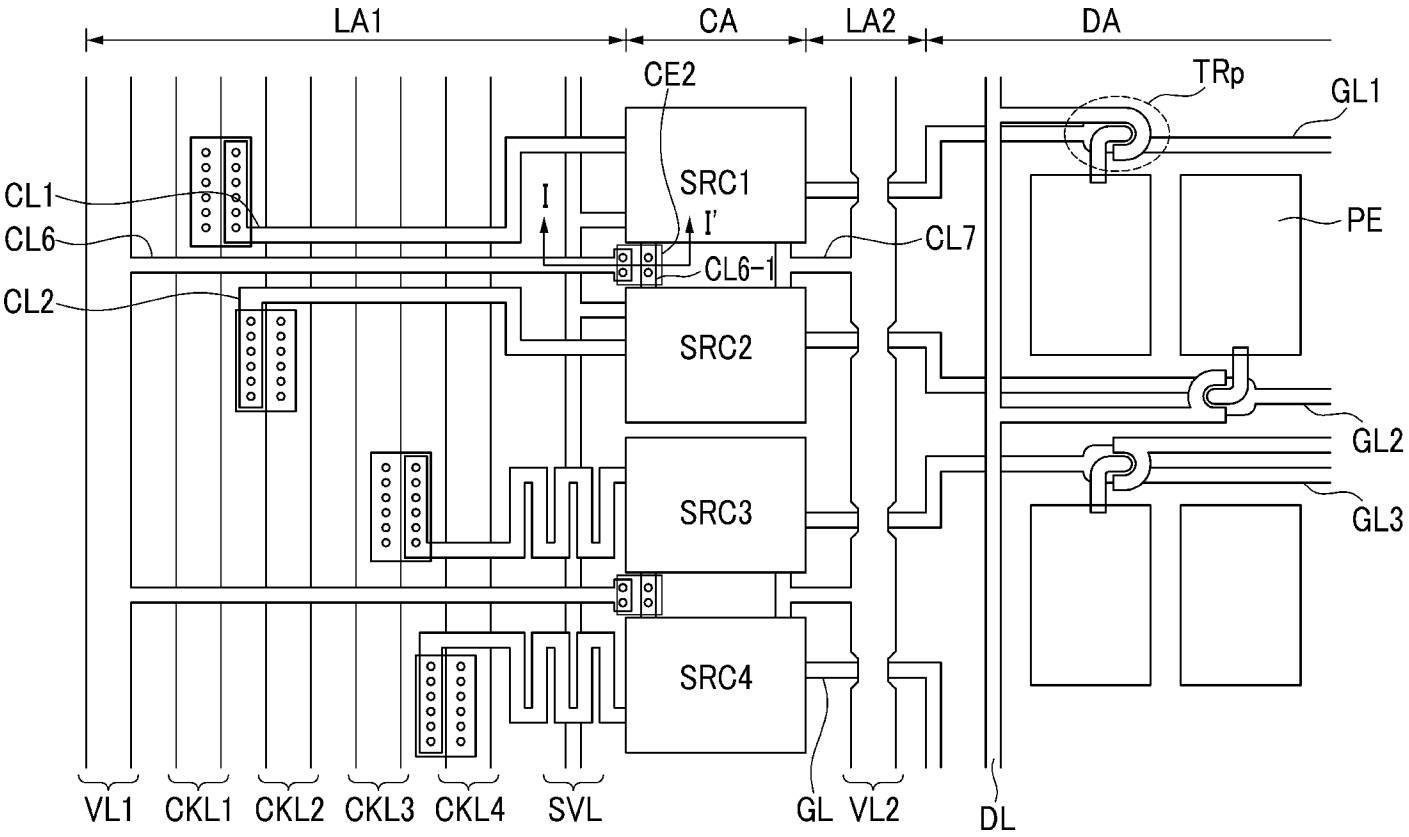
FIG. 12 is an enlarged plan view of area "A" of FIG. 1 according to an exemplary embodiment of the present invention.
Figure 13:
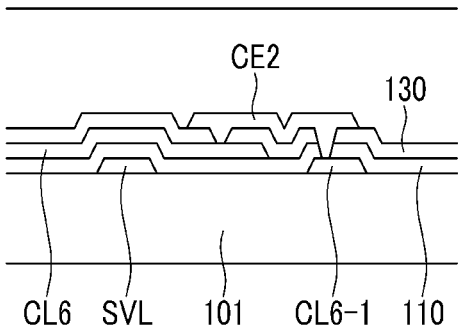
FIG. 13 is a cross-sectional view along line I-I' of FIG. 12.

FIG. 12 and FIG. 13 show another possible alternative according to an exemplary embodiment of the present invention. FIG. 12 is an enlarged plan view of area "A" of FIG. 1 according to an exemplary embodiment of the present invention, and FIG. 13 is a cross-sectional view along line I-I' of FIG. 12. Referring to FIG. 12 and FIG. 13, the sixth connection line CL6 may be formed from the second conductive layer. The first and second branches CL6-1 of the sixth connection line CL6, however, are formed from the first conductive layer. Here, the sixth connection line CL6 is coupled to the first and second branches CL6-1 via a contact hole in the insulating layer 110 and the passivation layer 130 and a contact hole in the passivation layer 130. A second connection electrode CE2 may be used to couple the sixth connection line CL6 to the first and second branches CL6-1. As is evident, numerous combinations using the first and second conductive layers are possible.

Figure 14:
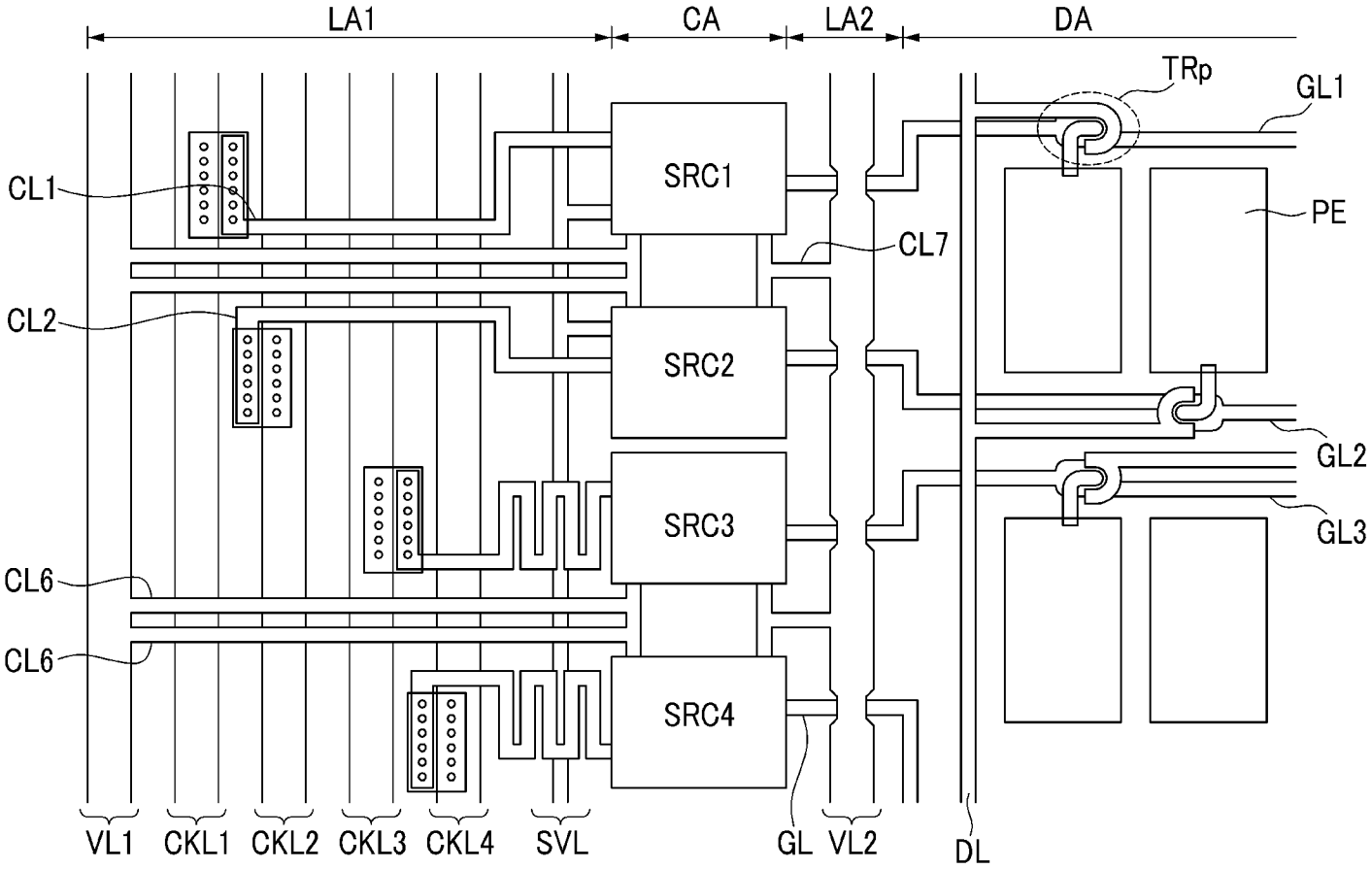
FIG. 14 is an enlarged plan view of area "A" of FIG. 1 according to an exemplary embodiment of the present invention.
Figure 15:
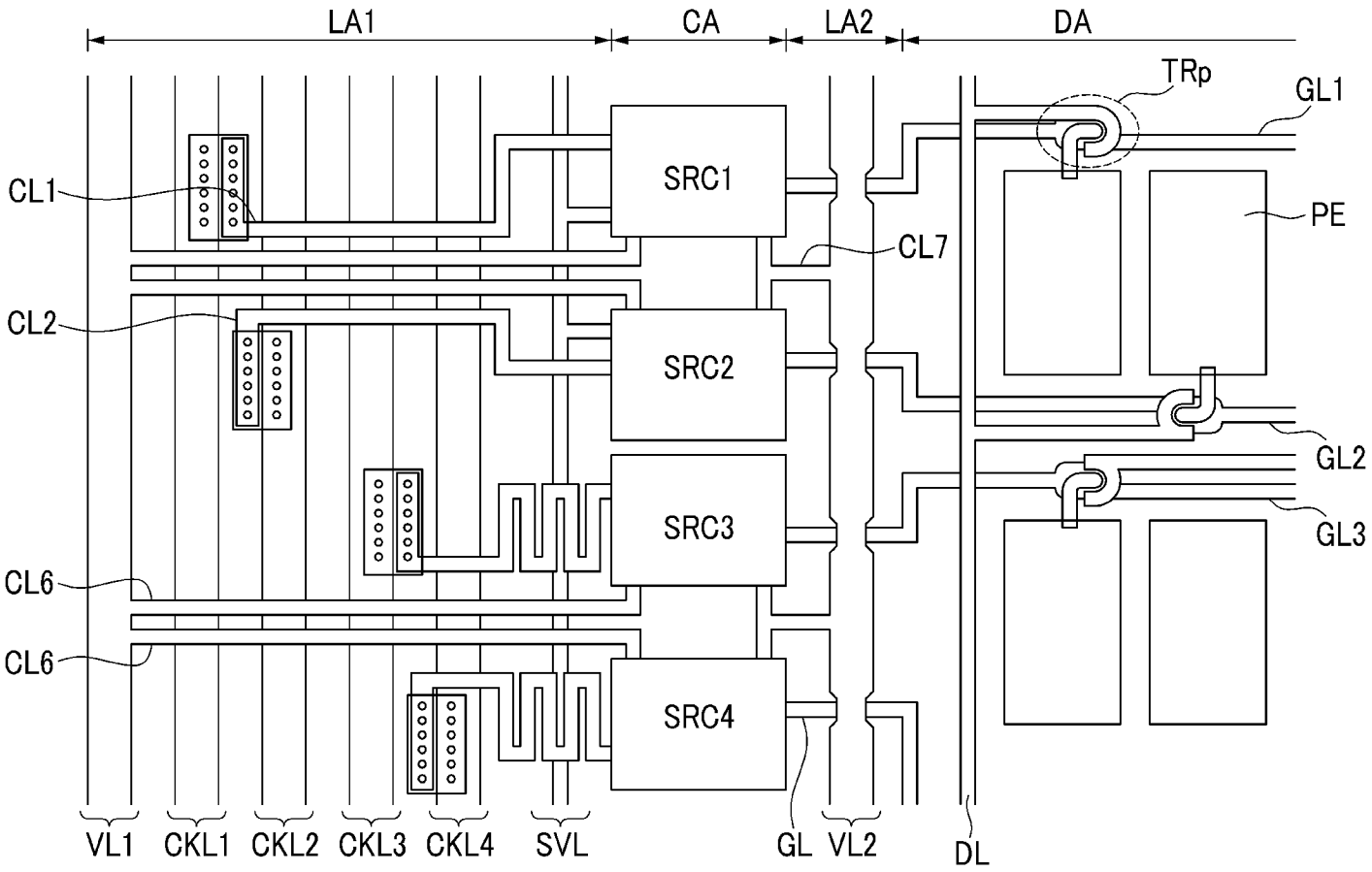
FIG. 15 is an enlarged plan view of area "A" of FIG. 1 according to an exemplary embodiment of the present invention.
Figure 16:
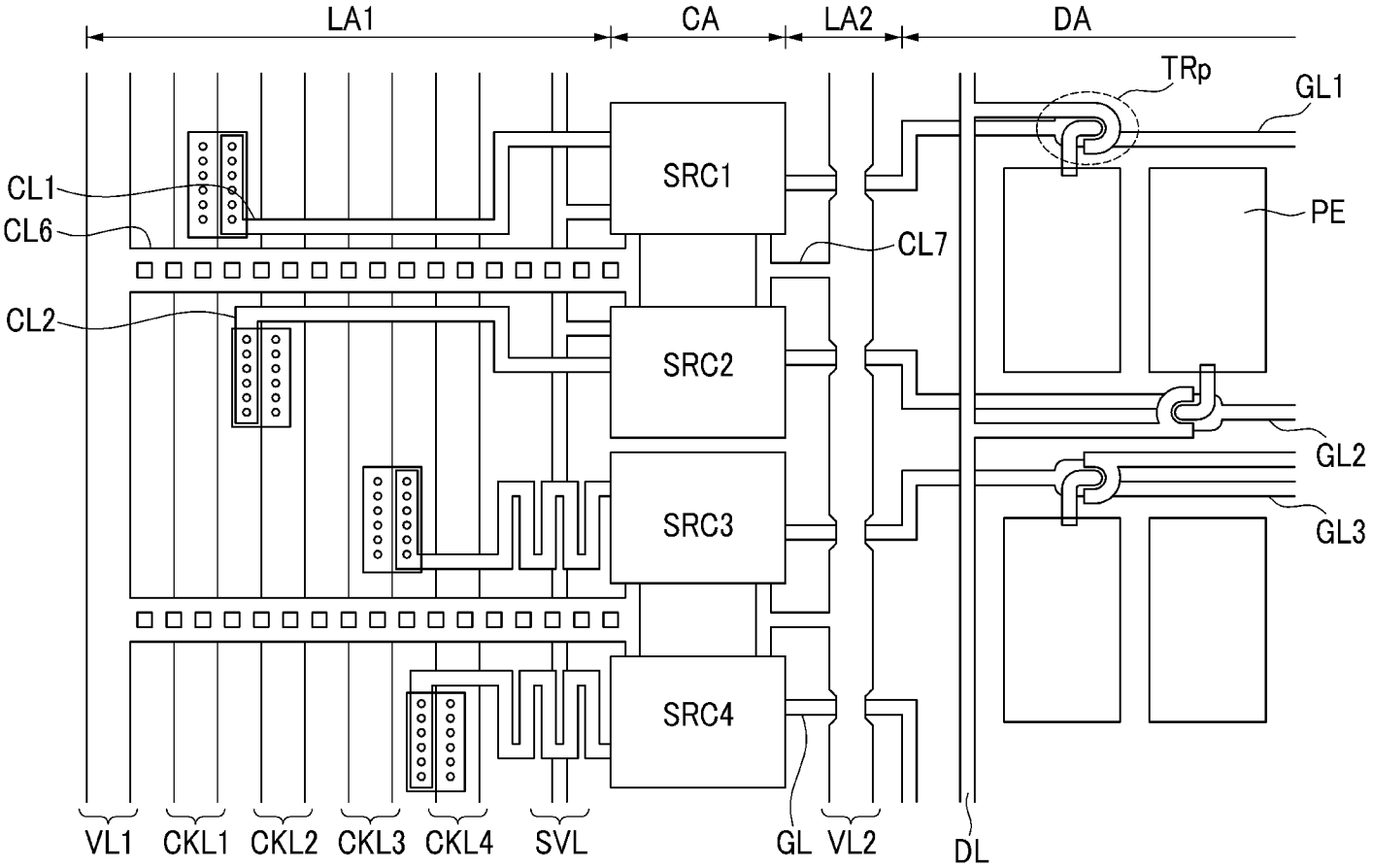
FIG. 16 is an enlarged plan view of area "A" of FIG. 1 according to an exemplary embodiment of the present invention.

FIG. 14, FIG. 15, and FIG. 16, which are enlarged plan views of area "A" of FIG. 1, show other possible alternatives according to exemplary embodiments of the present invention. Although a single, sixth connection line CL6 is used to couple the first voltage line VL1 to two adjacent stages (e.g., SRC1 and SRC2, SRC3 and SRC4, . . . ) in FIG. 3, various alternatives are possible. For example, as shown in FIG. 14, the sixth connection line CL6 may include two lines to couple the first voltage line VL1 to two adjacent stages (e.g., SRC1 and SRC2, SRC3 and SRC4, . . . ). Unlike FIG. 14, as FIG. 15 shows, the two sixth connection lines CL6 used to couple the first voltage line VL1 to two adjacent stages may be spaced apart from each other with no portion of either connection line CL6 being directly connected to the other connection line CL6. Further, FIG. 16 shows the sixth connection line CL6 having multiple openings. In other words, the sixth connection line CL6 may be formed to have various shapes, including the ladder-shape shown in FIG. 16.

Figure 7:
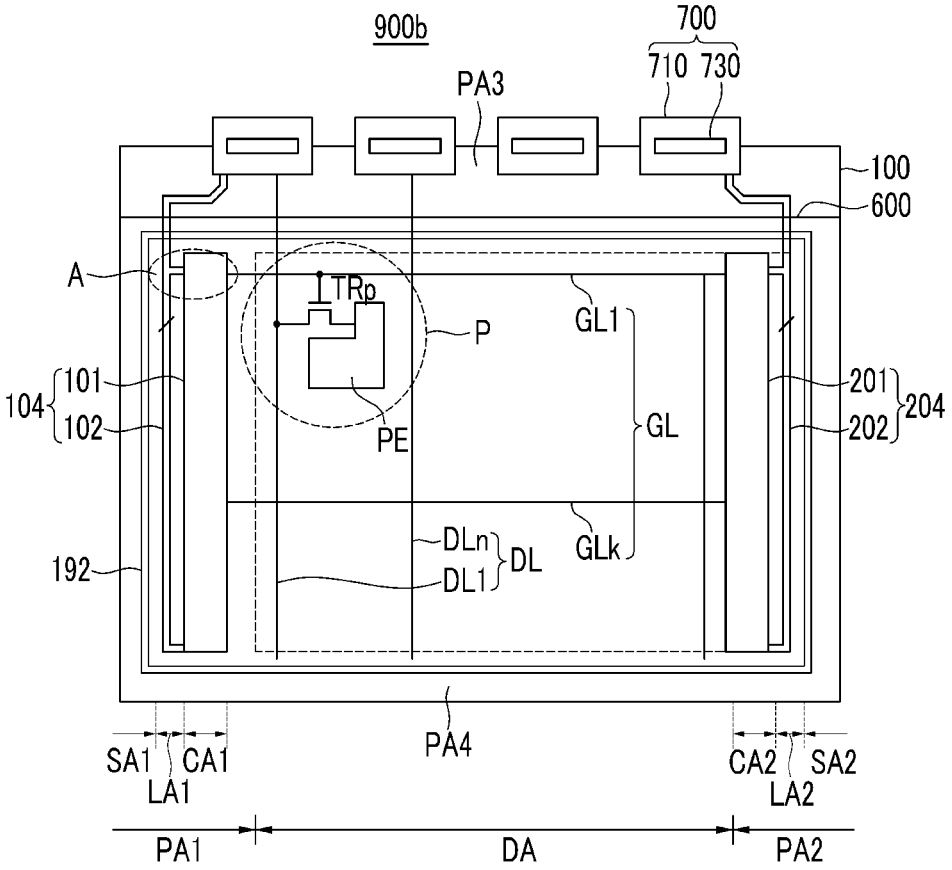
FIG. 7 is a plan view of another display apparatus according to an exemplary embodiment of the present invention.

FIG. 7 is a plan view of another display apparatus according to an exemplary embodiment of the present invention. Referring to FIG. 7, a display apparatus 900*b* includes a display substrate 100 and an opposing substrate 600 facing the display substrate 100. Similar to the exemplary embodiment described above, the display apparatus 900*b* may be, for example, an LCD, EPD, or OLED device.

The display substrate 100 includes a display area DA, in which images are formed, and a peripheral area. The peripheral area may surround the display area DA. In this case, the peripheral area may include a first peripheral area PA1, a second peripheral area PA2, a third peripheral area PA3, and a fourth peripheral area PA4. The first and second peripheral areas PA1 and PA2 are on opposite sides of the display area DA from each other. Similarly, the third and fourth peripheral areas PA3 and PA4 are on opposite sides of the display area DA from each other.

The display area DA includes multiple gate lines GL and multiple data lines DL that cross with the gate lines GL. Pixels P may be formed at each crossing point of the gate lines GL and data lines DL. For example, a pixel P may include a pixel transistor TRp and a pixel electrode PE. The pixel transistor TRp is coupled to a gate line GL and a data line DL, and the pixel electrode PE is coupled to the pixel transistor TRp.

The first peripheral area PA1 is adjacent to one end of the gate lines GL, and the second peripheral area PA2 is adjacent to the other end of the gate lines GL. The third peripheral area PA3 is adjacent to one end of the data lines DL, and the fourth peripheral area PA4 is adjacent to the other end of the data lines DL.

The first peripheral area PA1 includes a first circuit area CA1, a first line area LA1, and a first sealing area SA1. The first circuit area CA1 includes a first circuit 101 of a first gate driver 104. The first line area LA1 includes first conductors 102 of the first gate driver 104. The first sealing area SA1 includes a sealing member 192. The first conductors 102 provide control signals to the first circuit 101, which produces gate signals using the signals from the first conductors 102 and transfers the gate signals to gate lines GL.

The second peripheral area PA2 includes a second circuit area CA2, a second line area LA2, and a second sealing area SA2. The second circuit area CA2 includes a second circuit 201 of a second gate driver 204. The second line area LA2 includes second conductors 202 of the second gate driver 204. The second sealing area SA2 includes a sealing member 192. The second conductors 202 provide control signals to the second circuit 201, which produces gate signals using the signals from the second conductors 202 and transfers the gate signals to gate lines GL. Because the second gate driver 204 may be structured similar to the first gate driver 104, the following description concerning the first gate driver 104 may be applied to the second gate driver 204. Thus, a description of the second gate driver 204 is omitted except where it may differ from the first gate driver 104.

The first circuit 101 may apply gate signals to a first group of gate lines GL, and the second circuit 201 may apply gate signals to a second group of gate lines GL. Here, the first group of gate lines GL may include the same gate lines as the second group of gate lines GL. Alternatively, the first group of gate lines GL and the second group of gate lines GL may include different gate lines GL from each other. In this case, the gate lines GL of each group may be driven using an interlaced method line by line, group by group, or block by block, where a block of gate lines GL includes fewer gate lines GL than a group.

The second line area LA2 and the second circuit area CA2 are not required. If they are not included (i.e., if the second gate driver 204 is not included), the first gate driver 104 may apply gate signals to all gate lines GL.

The opposing substrate 600 faces the display substrate 100 and is attached to the display substrate 100 with the sealing member 192. The opposing substrate 600 may be arranged parallel to the display substrate 100. When the display apparatus 900*b* is a liquid crystal display (LCD), an LC layer may be disposed between the display substrate 100 and the opposing substrate 600 and sealed with the sealing member 192. When the display apparatus 900*b* is an electro-phoretic display (EPD), an electro-phoretic ink capsule may be disposed between the display substrate 100 and the opposing substrate 600 and sealed with the sealing member 192. The sealing member 192 may alternatively include a pattern that does not seal the whole outside of the electro-phoretic ink capsule but opening some portion of the sealing member 192 so that the sealing member 192 attaches the display substrate 100 and the opposing substrate 600. When the display apparatus 900*b* is an organic light emitting display (OLED), the sealing member 192 may be the same as that of LCD or EPD. The sealing member 192 may overlap the display area DA to enhance the adhesive strength between the display substrate 100 and the opposing substrate 600.

The data driving part 700 includes a FPC 710 and a data driving IC 730 attached to the FPC 710. The FPC 710 couples an outer device (not shown) to the data driving IC 730. The FPC 710 also couples the data driving IC 730 to the display substrate 100.

Figure 8:
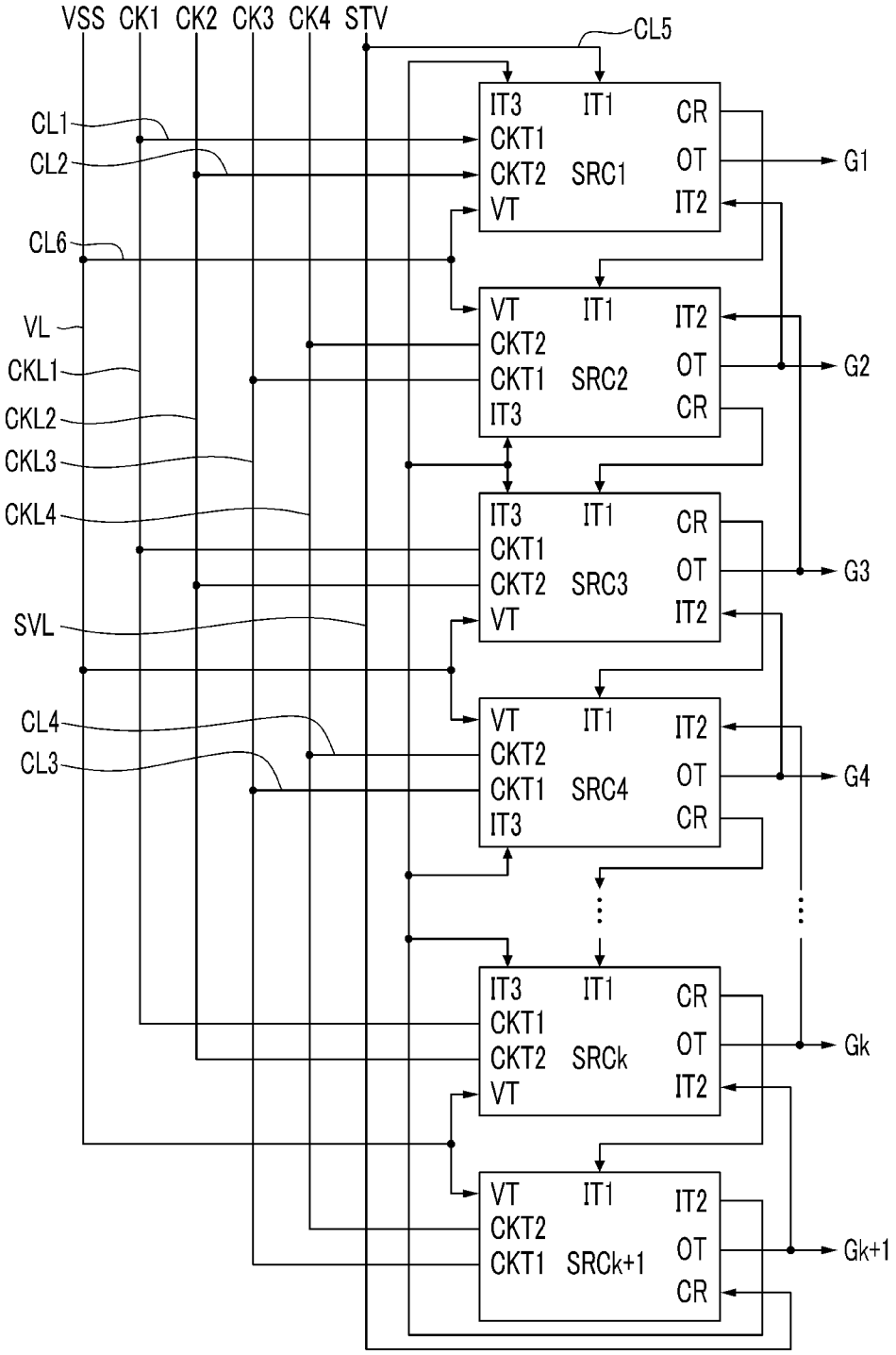
FIG. 8 is a block diagram of a gate driver area of the display apparatus shown in FIG. 7 according to an exemplary embodiment of the present invention.

FIG. 8 is a block diagram of a gate driver area of the display apparatus 900*b* shown in FIG. 7 according to an exemplary embodiment of the present invention. Referring to the FIG. 7 and FIG. 8, the gate driver 104 includes a first circuit 101 and first conductors 102. The first circuit 101 is formed in the first circuit area CA1 and includes a shift register having multiple stages SRC1 . . . SRCk+1. The first through the k+1-th stages SRC1 . . . SRCk+1 are coupled the first through the k-th gate lines GL and a k+1-th dummy gate line, respectively. The first through k-th gate lines GL are formed in the display area DA, and the k+1-th dummy gate line may be formed in a peripheral area. Alternatively, the k+1-th dummy gate line may be a floating terminal instead of a gate line. The stages SRC1 . . . SRCk+1 sequentially output gate signals G1 . . . Gk+1 to the gate lines GL.

Figure 9:
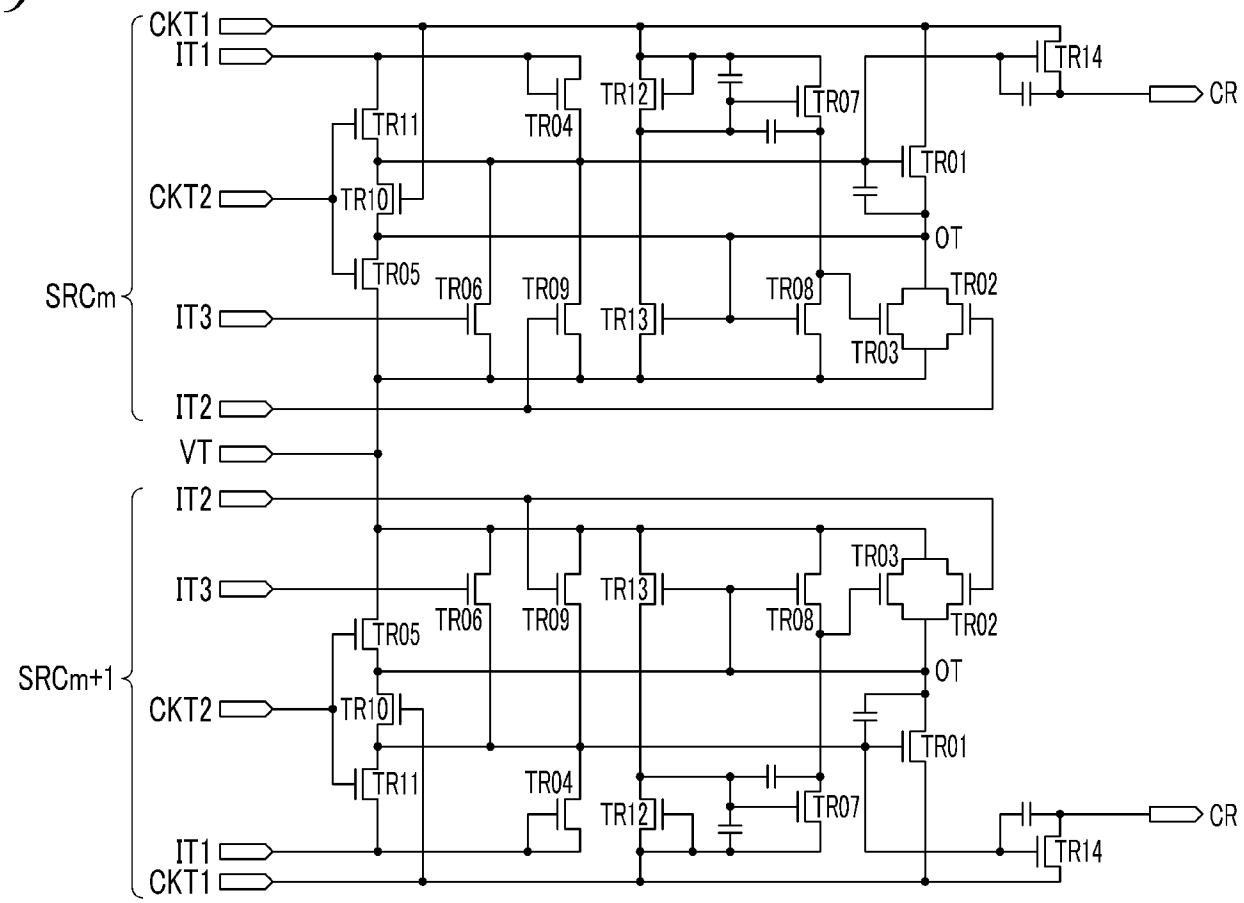
FIG. 9 is a circuit diagram of an m-th stage and m+1-th stage of the gate drivers of FIG. 8 according to an exemplary embodiment of the present invention.

The stages SRC may be designed in numerous ways. FIG. 8 and FIG. 9 show one example of a stage according to an exemplary embodiment of the present invention. Referring to FIG. 8, an n-th stage SRCn (n is a natural number that is less than or equal to k) includes eight terminals. These eight terminals include a first input terminal IT1, a second input terminal IT2, a third input terminal IT3, a voltage terminal VT, a first clock terminal CKT1, a second clock terminal CKT2, a carry terminal CR, and an output terminal OT.

The first input terminal IT1 receives a start control signal. Depending on the stage, the start control signal may be a vertical start signal STV or it may be a carry signal CRS from a previous stage. The second input terminal IT2 receives a stop control signal. Depending on the stage, the stop control signal may be a gate signal Gn from a following stage or a vertical start signal STV of the next frame. The third input terminal IT3 receives the carry signal CRS from the final stage SRCk+1. The voltage terminal VT receives a direct current voltage VSS. Each of the first clock terminal CKT1 and the second clock terminal CKT2 receives one of the clock signals CK1, CK2, CK3, and CK4. An output terminal OT outputs a gate driving signal and is coupled to a gate line GL. The carry terminal CR outputs a carry signal CRS. FIG. 8 shows that the carry terminal CR is a distinct terminal from the output terminal OT. Because the carry signal CRS and the gate signal Gn may be substantially the same signal, the carry terminal CR may alternatively be merged with the output terminal OT. In this case, the gate signal Gn output from the output terminal OT may also serve the function of the carry signal CRS.

The first conductors 102 include a voltage line and signal lines that substantially extend the length of the circuit 101, as well as connection lines that connect the voltage and signal lines to the stages SRC. Specifically, the first conductors 102 include a voltage line VL, a vertical start signal line SVL, a first clock signal line CKL1, a second clock signal line CKL2, a third clock signal line CKL3, a fourth clock signal line CKL4. The connection lines include first, second, third, fourth, fifth, and sixth connection lines CL1, CL2, CL3, CL4, CL5, and CL6. The voltage/signal lines VL, CKL1, CKL2, CKL3, CKL4, and SVL extend in a first direction, and the first through sixth connection lines CL1, CL2, CL3, CL4, CL5, and CL6 extend in a second direction that crosses the first direction. Although the first conductors 102 are described here as being "lines," the term "lines" is used for convenience and not limitation. For example, the term "lines" does not require that the first conductors 102 be formed in a line or that they be formed of a continuous line of the same material. The voltage/signal lines VL, CKL1, CKL2, CKL3, CKL4, and SVL may be formed with a different conductive layer than the first through sixth connection lines CL1, CL2, CL3, CL4, CL5, and CL6. Alternatively, some of the voltage/signal lines VL, CKL1, CKL2, CKL3, CKL4, and SVL may be formed with the same conductive layer as the first through sixth connection lines CL1, CL2, CL3, CL4, CL5, and CL6.

The voltage line VL transmits a voltage VSS, which may be a direct current voltage. The clock signal lines CKL1, CKL2, CKL3, and CKL4 transmit clock signals CK1, CK2, CK3, and CK4, respectively. The vertical start signal line SVL transmits a vertical start signal STV. The first clock signal line CKL1 and the second clock signal line CKL2 may be coupled to odd numbered stages SRC1, SRC3, SRC5, . . . , and the third clock signal line CKL3 and the fourth clock signal line CKL4 may be coupled to even numbered stages SRC2, SRC4, SRC6, . . . .

The first through fourth connection lines CL1, CL2, CL3, and CL4 couple the clock signal lines CKL1, CKL2, CKL3, and CKL4, respectively, to clock terminals CKT1 or CKT2. The fifth connection line CL5 couples the vertical start signal line SVL to a first input terminal IT1 or a second input terminal IT2. The sixth connection line CL6 couples the voltage terminal VT to the voltage line VL.

The voltage, signal, and connection lines of the first and second conductors 102 and 202 may be formed using various combinations of conductive layers. For example, the clock signal lines CKL1, CKL2, CKL3, and CKL4 and the vertical start signal line SVL may be formed with a first conductive layer. The first through sixth connection lines CL1, CL2, CL3, CL4, CL5, and CL6 and the voltage line VL may be formed with a second conductive layer that is different from the first conductive layer. Here, an insulating layer may be formed on the first conductive layer, and the second conductive layer may be formed on the insulating layer. Some or the entire clock signal lines CKL1 . . . CKL4 and the vertical start signal line SVL may be formed with the second conductive layer. Lines formed of the first conductive layer may be coupled to lines formed of the second conductive layer via a third conductive layer. Alternatively, lines formed of the first conductive layer may be directly coupled to lines formed of the second conductive layer via a contact hole formed in the insulating layer.

FIG. 8 shows the gate driver 104 including four clock signal lines so that four clock signals may be provided to the stages. Alternatively, exemplary embodiments of the present invention may be applied to gate drivers including fewer clock signal lines (e.g., two) or more clock signal lines (e.g., six).

As FIG. 8 shows, a single, sixth connection line CL6 is used to couple the voltage line VL to two adjacent stages (e.g., SRC1 and SRC2, SRC3 and SRC4, . . . ). More specifically, a single, sixth connection line CL6 extends from the voltage line VL and splits into a first branch and a second branch. The first branch is coupled to the voltage terminal VT of one stage SRCn, and the second branch is coupled to the first voltage terminal VT of an adjacent stage SRCn+1. Although the sixth connection line CL6 is shown splitting into two branches, other connection lines may be configured in a similar manner. Further, the sixth connection line CL6, or other connection lines, may split into three or more branches so that one connection line may be coupled to three or more stages or three or more terminals of the stages.

FIG. 9 is a circuit diagram of an m-th stage and m+1-th stage of the gate drivers of FIG. 8 according to an exemplary embodiment of the present invention. FIG. 9 shows one example of a stage SRC according to an exemplary embodiment of the present invention. The stages SRC, however, may have various circuit structures configured to output gate signals. Further, FIG. 9 shows a pair of stages SRCm and SRCm+1 in a middle area of the multiple stages SRC. Stages SRC at the beginning and end of the first circuit area CA1 may have a different structure from that shown in FIG. 8.

Referring to the m-th stage SRCm of FIG. 8 and FIG. 9, clock signal lines CKL1, CKL2, CKL3, and CKL4 are coupled to the first clock terminal CKT1 or the second clock terminal CKT2 through the first to fourth connection lines CL1, CL2, CL3, and CL4 so that the clock signals CK1, CK2, CK3, and CK4 may be applied to the clock terminals CKT1 and CKT2. The voltage line VL is coupled to the voltage terminal VT through the sixth connection line CL6 so that the voltage VSS may be applied to the voltage terminal VT. The voltage VSS may be a direct current voltage. The first input terminal IT1 is coupled to a conductive line that transfers one of the carry signals CRS of a previous stage or the fifth connection line CL5, which transmits the vertical start signal STV, so that a carry signal CRS or the vertical start signal STV may be applied to the first input terminal IT1. The second input terminal IT2 is coupled to a conductive line that transfers a gate signal Gn of a following stage or a fifth connection line CL5 that transfers the vertical start signal STV of the next frame. The conductive line that transfers a gate signal Gn to a previous stage may be directly coupled to a gate line GLn or be coupled to a terminal formed in a stage like a carry terminal CR. The third input terminal IT3 is coupled to the carry terminal CR of the last stage SRCk+1 through a conductive line so that the last carry signal CRS may be applied to the third input terminal IT3 of the first through kth stages SRC1 . . . SRCk.

Unlike conventional shift register stages, the m-th stage SRCm and the m+1-th stage SRCm+1 do not have the same configuration. Referring to FIG. 8 and FIG. 9, the voltage terminal VT of the first stage SRC1 is disposed at a lower portion of the first stage SRC1, and the voltage terminal VT of the second stage SRC2 is disposed at an upper portion of the second stage SRC2. Similarly, the third input terminal IT3 of the first stage SRC1 is disposed at an upper portion of the first stage SRC1, and the third input terminal IT3 of the second stage SRC2 is disposed at a lower portion of the second stage SRC2. Thus, unlike the conventional configuration, this configuration allows the voltage terminals VT of the first and second stages SRC1 and SRC2 to face each other. Also, the third input terminals IT3 of the second and third stages SRC2 and SRC3 face each other.

When neighboring stages are configured with like terminals facing each other, less wiring may be needed because at lease one connection line of the first through sixth connection lines CL1, CL2, CL3, CL4, CL5, and CL6 may be coupled to two or more stages.

According to an exemplary embodiment of the present invention, the structure of the m+1-th stage SRCm+1 may be a mirror image of the structure of the m-th stage SRCm. In FIG. 8 and FIG. 9, the entire m-th stage SRCm and the entire m+1-th stage SRCm+1, both of which include transistors TR01-TR14, are shown as mirror images of each other. This is not necessary, however, because some elements of the neighboring stages need not be structured in a mirror image of each other. In other words, a portion of the m-th stage SRCm may be a mirror image of a portion the m+1-th stage SRCm+1, and another portion of the m-th stage SRCm may not be a mirror image of another portion of the m+1-th stage SRCm+1.

In the exemplary embodiment of FIGS. 7-9, some of the description is omitted. Therefore, all of the description pertaining to the exemplary embodiments of FIGS. 1-6C that is possible to adapt to the exemplary embodiment of FIGS. 7-9 may be applied to the exemplary embodiment of FIGS. 7-9, and vice-versa. Furthermore, the alternative exemplary embodiments shown in FIGS. 10-16 may also be applied to the embodiment of FIGS. 7-9.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus, comprising:

a substrate;

a display area and a peripheral area on the substrate, the peripheral area being outside the display area;

a driving circuit disposed in the peripheral area;

a first conductive line in the peripheral area and extending in a first direction;

a second conductive line in the peripheral area and extending in a second direction crossing the first direction;

a third conductive line in the peripheral area and extending in the first direction, wherein the driving circuit is disposed between the first conductive line and the third conductive line, and wherein the second conductive line couples the first conductive line to the driving circuit, the second conductive line comprising:

a first branch coupled to a first terminal of the driving circuit; and a second branch coupled to a second terminal of the driving circuit.

2. The display apparatus of claim 1, wherein the second conductive line extends between the first conductive line and the first and second branches.

3. The display apparatus of claim 2, wherein the second conductive line comprises a single line.

4. The display apparatus of claim 2, wherein the first conductive line and the second conductive line are formed with the same conductive layer.

5. The display apparatus of claim 1, wherein the driving circuit comprises a gate driving circuit comprising a plurality of stages coupled to a plurality of gate lines, respectively, a first stage of the plurality of stages comprises the first terminal, and a second stage of the plurality of stages comprises the second terminal.

6. The display apparatus of claim 5, wherein the first terminal and the second terminal are configured to receive a first voltage having a constant magnitude.

7. The display apparatus of claim 6, further comprising:

a fourth conductive line in the peripheral area and extending in a third direction, wherein the fourth conductive line couples the third conductive line to the driving circuit, and the fourth conductive line comprises a third branch coupled to a third terminal of the driving circuit and a fourth branch coupled to a fourth terminal of the driving circuit.

8. The display apparatus of claim 7, wherein the second direction and the third direction are opposite directions.

9. The display apparatus of claim 8, wherein the first stage comprises the third terminal, and the second stage comprises the fourth terminal.

10. The display apparatus of claim 9, wherein the third terminal and the fourth terminal are configured to receive a second voltage having a constant magnitude.

11. The display apparatus of claim 8, wherein the first conductive line and the third conductive line are formed of the same layer.

12. The display apparatus of claim 5, wherein at least a portion of the second stage is a mirror image of at least a portion of the first stage.

13. The display apparatus of claim 12, wherein the entire second stage is a mirror image of the entire first stage.

14. The display apparatus of claim 5, further comprising a first clock signal line, a second clock signal line, a third clock signal line, and a fourth clock signal line, wherein the first clock signal line is coupled to the first stage, the second clock signal line is coupled to the second stage, the third clock signal line is coupled to a third stage of the plurality of stages, and the fourth clock signal line is couple to a fourth stage of the plurality of stages.

15. The display apparatus of claim 14, wherein the second conductive line crosses at least one of the first clock signal line, the second clock signal line, the third clock signal line, and the fourth clock signal line.

16. The display apparatus of claim 1, further comprising:

another driving circuit disposed in the peripheral area;

a fourth conductive line in the peripheral area and extending in a third direction, the third direction crossing the first direction, wherein the fourth conductive line couples the third conductive line to the another driving circuit, and the fourth conductive line comprises a third branch coupled to a third terminal of the another driving circuit and a fourth branch coupled to a fourth terminal of the another driving circuit.

17. The display apparatus of claim 16, wherein the display area is disposed between the driving circuit and the another driving circuit.

18. A display apparatus, comprising:

a substrate;

a display area and a peripheral area on the substrate, the peripheral area being outside the display area;

a gate driving circuit disposed in the peripheral area, the gate driving circuit comprising a first stage coupled to a first gate line and a second stage coupled to a second gate line, each of the first stage and the second stage comprising a plurality of terminals;

a first conductive line in the peripheral area and extending in a first direction;

a second conductive line in the peripheral area and extending in a second direction crossing the first direction;

a third conductive line in the peripheral area and extending in the first direction, wherein:

the second conductive line extends from the first conductive line and splits into a first part coupled to a first terminal of the first stage and a second part coupled to a first terminal of the second stage; and the gate driving circuit is disposed between the first conductive line and the third conductive line.

19. The display apparatus of claim 18, wherein the first terminal of the first stage and the first terminal of the second stage are configured to receive a voltage having a constant magnitude.

20. A display apparatus, comprising:

a substrate;

a display area and a peripheral area on the substrate, the peripheral area being outside the display area; and a gate driving circuit disposed in the peripheral area, the gate driving circuit comprising a first stage coupled to a first gate line and a second stage coupled to a second gate line, each of the first stage and the second stage comprising a first terminal, and each of the first stage and the second stage comprising a lower area and an upper area;

a first conductive line in the peripheral area and extending in a first direction;

a second conductive line in the peripheral area and extending in a second direction crossing the first direction; and a third conductive line in the peripheral area and extending in the first direction, wherein the lower area of the first stage is disposed between the upper area of the first stage and the upper area of the second stage, and the upper area of the second stage is disposed between the lower area of the first stage and the lower area of the second stage, wherein the first terminal of the first stage is disposed in the lower area of the first stage, and the first terminal of the second stage is disposed in the upper area of the second stage, and wherein the gate driving circuit is disposed between the first conductive line and the third conductive line.

21. The display apparatus of claim 20, wherein the second conductive line extends from the first conductive line and splits into a first part coupled to the first terminal of the first stage and a second part coupled to the first terminal of the second stage.

22. A display apparatus, comprising:

a substrate;

a display area and a peripheral area on the substrate, the peripheral area being outside the display area; and a gate driving circuit disposed in the peripheral area, the gate driving circuit comprising a first stage coupled to a first gate line and a second stage coupled to a second gate line, wherein the first stage and the second stage being mirror images of each other about a longitudinal direction of extension of a conductive line disposed between the first stage and the second stage, wherein different extensions of the conductive line connect to first facing terminals of the first stage and the second stage, and wherein the conductive line comprises a plurality of openings spaced apart from one another in the longitudinal direction of extension.

23. The display apparatus of claim 22, further comprising:

a second conductive line disposed between the first stage and the second stage, wherein different extensions of the second conductive line connect to second facing terminals of the first stage and the second stage, wherein the first conductive line and the second conductive line are constant voltage lines.

24. A display apparatus, comprising:

a substrate;

a display area and a peripheral area on the substrate, the peripheral area being outside the display area;

a driving circuit disposed in the peripheral area, the driving circuit comprising a plurality of stages coupled to a plurality of gate lines, respectively, a first stage of the plurality of stages comprises a first terminal and a second terminal, and a second stage of the plurality of stages comprises a third terminal and a fourth terminal;

a first conductive line in the peripheral area and extending in a first direction;

a second conductive line in the peripheral area and extending in a second direction crossing the first direction;

a third conductive line in the peripheral area and extending in the first direction; and a fourth conductive line in the peripheral area and extending in a third direction, wherein the second conductive line couples the first conductive line to the driving circuit, and the second conductive line comprises a first branch coupled to the first terminal of the first stage and a second branch coupled to the third terminal of the second stage, wherein the fourth conductive line couples the third conductive line to the driving circuit, and the fourth conductive line comprises a third branch coupled to the second terminal of the first stage and a fourth branch coupled to the fourth terminal of the second stage, and wherein the fourth conductive line overlaps with the plurality of gate lines, and the fourth conductive line is narrower at portions where it overlaps with the plurality of gate lines that at portions where it does not overlap with the plurality of gate lines.

* * * * *